US011351800B2

(12) United States Patent
Arakane

(10) Patent No.: US 11,351,800 B2
(45) Date of Patent: Jun. 7, 2022

(54) IMAGE RECORDING APPARATUS, CONTROL METHOD THEREOF, AND MEDIUM STORING PROGRAM EXECUTABLE BY IMAGE RECORDING APPARATUS

(71) Applicant: Brother Kogyo Kabushiki Kaisha, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/032,276

(22) Filed: Sep. 25, 2020

(65) Prior Publication Data

US 2021/0086534 A1 Mar. 25, 2021

(30) Foreign Application Priority Data

Sep. 25, 2019 (JP) ..... JP2019-174147

(51) Int. Cl.
*B41J 11/00* (2006.01)
*B41J 19/20* (2006.01)
*B41J 25/00* (2006.01)

(52) U.S. Cl.
CPC ..... *B41J 25/006* (2013.01); *B41J 11/0065* (2013.01); *B41J 19/202* (2013.01)

(58) Field of Classification Search
CPC ..... B41J 25/006; B41J 11/0065; B41J 19/202
See application file for complete search history.

(56) References Cited

U.S. PATENT DOCUMENTS 6,260,945 B1 * 7/2001 Niikura ..... B41J 19/202 400/279
2016/0229199 A1 * 8/2016 Nakai ..... B41J 11/0015

FOREIGN PATENT DOCUMENTS

JP 2009-298061 A 12/2009
JP 2016068305 A * 5/2016 ..... B41J 2/01

* cited by examiner

*Primary Examiner* — Yaovi M Ameh
(74) *Attorney, Agent, or Firm* — Banner & Witcoff, Ltd.

(57) ABSTRACT

There is provided an image recording apparatus including an image recording head; a scanner; a conveyer; and a controller. The controller is configured to execute first and second recording modes in which the controller causes the image recording head to accelerate to first and second velocities, to move at the first and second velocities, and then to decelerate from the first and second velocities, while causing the image recording head to record the image at least during moving at the first and second velocities, respectively. In a case that the controller has determined, based on printing data, that the image is to be recorded during a first velocity changing period, the controller executes the second recording mode. The first velocity changing period includes a first acceleration and deceleration periods in which the image recording head accelerates and decelerates, respectively.

18 Claims, 18 Drawing Sheets

Fig. 13

| PRINTING QUALITY | ABSENCE/PRESENCE OF MARGIN | PAPER SIZE | RECORDING MODE |
|---|---|---|---|
| STANDARD | PRESENCE | - | FIRST |
| | ABSENCE | ANY OTHER SIZE THAN A4/LETTER | FIRST |
| | | A4/LETTER | SECOND |
| HIGH IMAGE QUALITY | - | - | SECOND |

IMAGE RECORDING APPARATUS, CONTROL METHOD THEREOF, AND MEDIUM STORING PROGRAM EXECUTABLE BY IMAGE RECORDING APPARATUS

CROSS REFERENCE TO RELATED APPLICATION

The present application claims priority from Japanese Patent Application No. 2019-174147 filed on Sep. 25, 2019, the disclosure of which is incorporated herein by reference in its entirety.

BACKGROUND

The present disclosure relates to an image recording apparatus, a control method thereof, and a medium storing a program executable by the image recording apparatus.

A recording apparatus described in Japanese Patent Application Laid-open No. 2009-298061 that is a conventional image recording apparatus records an image on a recording medium by discharging a liquid from a recording head while moving the recording head in a scanning direction. In this recording apparatus, an increase in width of the apparatus is inhibited by performing recording in acceleration and deceleration sections of the recording head.

SUMMARY

In recent years, the moving velocity of the recording head has increased in response to the demand for fast printing. This lengthens the acceleration and deceleration sections, leading to an increase in size of the apparatus. In a configuration in which liquid is discharged at the time of the acceleration or deceleration of the recording head in order to inhibit the increase in size of the apparatus, such as the recording apparatus described in Japanese Patent Application Laid-open No. 2009-298061, a landing position of the liquid is shift from a landing position of the liquid that is discharged from the recording head moving at constant velocity. This reduces image quality.

The present disclosure is made to solve such a problem, and an object of the present disclosure is to provide an image recording apparatus that is capable of inhibiting a decrease in image quality while inhibiting an increase in size of the apparatus, a control method thereof, and a medium storing a program executable by the image recording apparatus.

An image recording apparatus according to an aspect of the present disclosure includes: an image recording head configured to record an image on a recording medium; a carriage configured to move the image recording head in a scanning direction within a scanning range; a conveyer configured to convey the recording medium in a conveyance direction intersecting with the scanning direction; and a controller. The controller is configured to execute a first recording mode and a second recording mode. The first recording mode is a mode in which the controller causes the image recording head to accelerate to a first velocity, to move at the first velocity, and then to decelerate from the first velocity, while causing the image recording head to record the image at least during moving at the first velocity. The second recording mode is a mode in which the controller causes the image recording head to accelerate to a second velocity lower than the first velocity, to move at the second velocity, and then to decelerate from the second velocity, while causing the image recording head to record the image at least during moving at the second velocity. In a case that the controller has determined, based on printing data, that the image is to be recorded in a first velocity changing period including a first acceleration period and a first deceleration period, the controller executes the second recording mode, the image recording head accelerating in the first acceleration period and decelerating in the first deceleration period.

Owing to the above configuration, an increase in size of the apparatus as well as deterioration in image quality are inhibited, by recording the image in accordance with the second recording mode of which movement range at the second velocity is larger than a movement range at the first velocity of the first recording mode, in a case that the size of the image is large.

According to the present disclosure, it is possible to provide an image recording apparatus that is capable of reducing a decrease in image quality while inhibiting an increase in size of the apparatus, a control method thereof, and a medium storing a program that is executed by the image recording apparatus.

BRIEF DESCRIPTION OF THE DRAWINGS

FIG. 13 is a table indicating printing conditions for the image recording apparatus according to the second embodiment of the present disclosure.

DESCRIPTION OF THE EMBODIMENTS

First Embodiment

<Configuration of Image Recording Apparatus>

Figure 1:
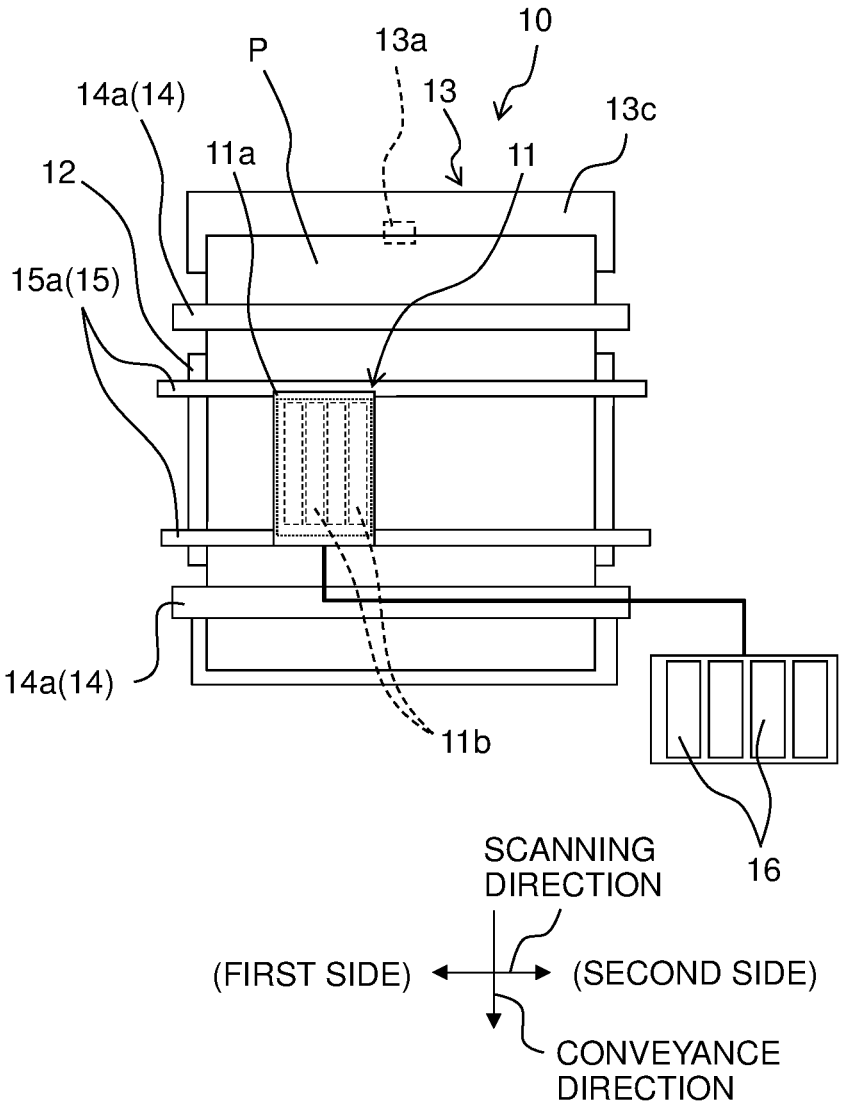
FIG. 1 schematically depicts a configuration of an image recording apparatus according to the first embodiment of the present disclosure.
Figure 2:
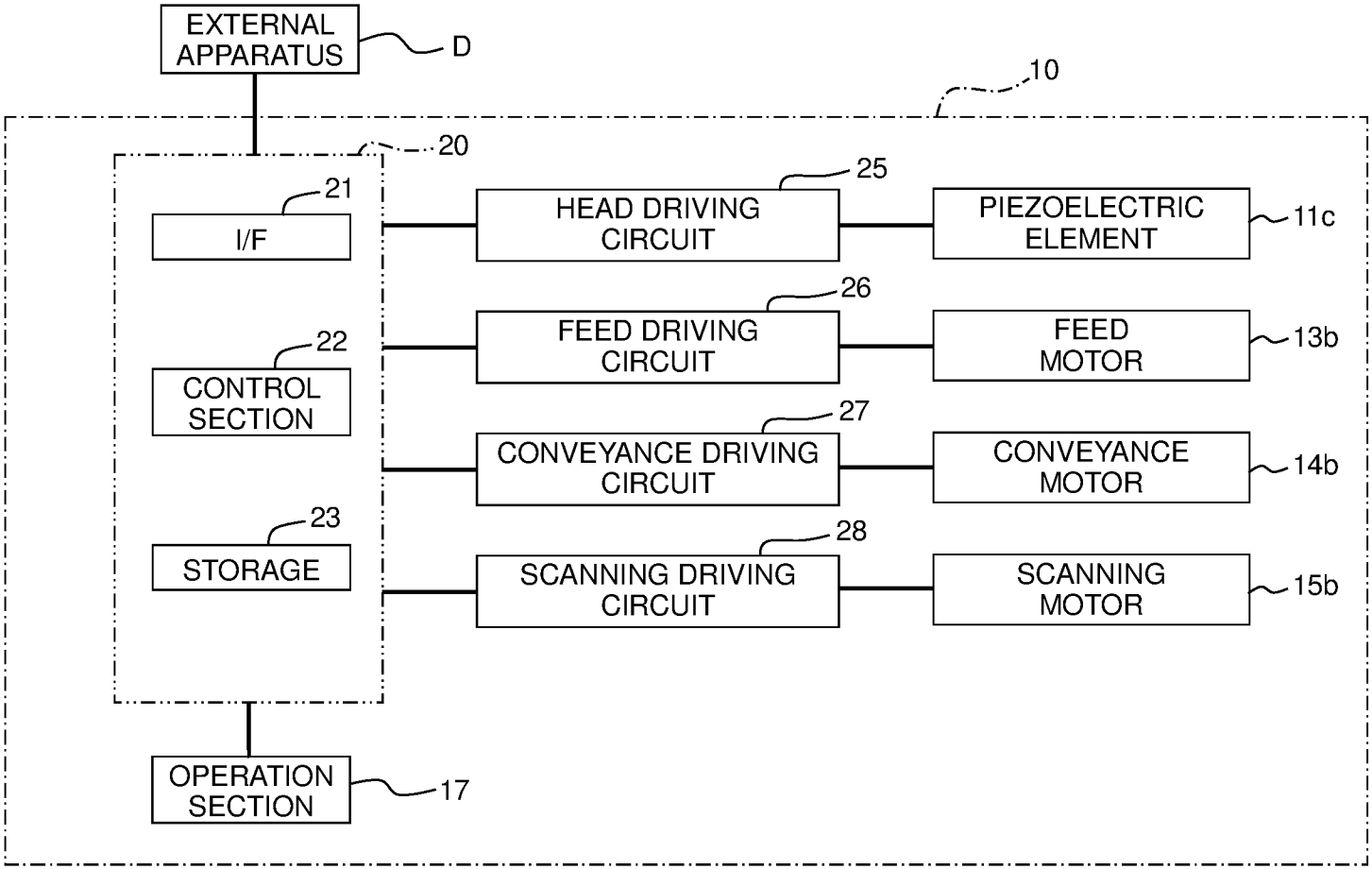
FIG. 2 is a block diagram of a functional configuration of the image recording apparatus in FIG. 1.

An image recording apparatus 10 according to the first embodiment of the present disclosure records an image on a recording medium as depicted in FIGS. 1 and 2. Explanation is made below about an example in which the image recording apparatus 10 is applied to an ink-jet printer that records an image by discharging a liquid such as ink. The image recording apparatus 10, however, is not limited thereto. Although paper P is explained as the recording medium, the recording medium is not limited thereto. The recording medium may be a sheet such as cloth.

The image recording apparatus 10 adopts a serial head system. The image recording apparatus 10 includes a head unit 11, a platen 12, a feeder (feed mechanism) 13, a conveyer (conveyance mechanism) 14, a carriage (scanner, scanning mechanism) 15, storage tanks 16, an operation section 17, and a controller 20.

The head unit 11 includes a carriage 11*a* and image recording heads 11*b*. The image recording heads 11*b* are carried on the carriage 11*a*. The image recording heads 11*b* reciprocate in a scanning direction together with the carriage 11*a*.

Each image recording head 11*b* includes a channel forming body and piezoelectric elements 11*c*. The inside of the channel forming body is formed having liquid channels. Nozzles of the liquid channels are opened in a lower surface of the channel forming body. Driving the piezoelectric elements 11*c* to change the volume of the liquid channels vibrates meniscuses in openings of the nozzles, thereby discharging liquid drops (liquid droplets) from the nozzles. Accordingly, an image is recorded on the paper P.

The platen 12 is a flat plate member. The paper P is placed on an upper surface of the platen 12. The platen 12 determines a distance between the paper P and lower surfaces of the image recording heads 11*b* facing the paper P. The side close to the image recording heads 11*b* with respect to the platen 12 is referred to as an upper side, and the opposite side is referred to as a lower side. The arrangement of the image recording apparatus 10, however, is not limited thereto.

The feeder 13 includes a feed roller 13*a* and a feed motor 13*b*. The feed roller 13*a* is placed on a feed tray 13*c* in which the paper P is accommodated. The feed roller 13*a* is configured to be brought into contact with the paper P. The feed roller 13*a* is connected to the feed motor 13*b*. Driving the feed motor 13*b* rotates the feed roller 13*a*, thereby feeding the paper P from the feed tray 13*c* onto the platen 12. The feeder 13 may be disposed on the lower side of the platen 12.

The conveyer 14 includes, for example, two conveyance rollers 14*a* and a conveyance motor 14*b*. The two conveyance rollers 14*a* interpose the platen 12 therebetween in a conveyance direction. The two conveyance rollers 14*a* are arranged parallel to each other. The conveyance rollers 14*a* are coupled to the conveyance motor 14*b*. Driving the conveyance motor 14*b* rotates the conveyance rollers 14*a*, thereby conveying, in the conveyance direction, the paper P on the platen 12 that is fed by the feeder 13.

The conveyance direction is a direction intersecting with (e.g., orthogonal to) the scanning direction. The conveyance roller 14*a* positioned at an upstream side in the conveyance direction may function also as the feed roller 13*a*. The conveyance roller 14*a* positioned at a downstream side in the conveyance direction may function also as a discharge roller by which the paper P is conveyed and discharged from the platen 12 to the outside of the image recording apparatus 10 or on a discharge tray. The image recording apparatus 10 may include a discharge roller different from the conveyance roller 14*a*, and the paper P may be discharged by the discharge roller.

The scanner 15 includes two guide rails 15*a*, a scanning motor 15*b*, an endless belt, and the like. The carriage 11*a* of the head unit 11 is supported by the two guide rails 15*a* and is fixed to the endless belt. Driving the scanning motor 15*b* causes the endless belt coupled to the scanning motor 15*b* to run. This causes the carriage 11*a* to reciprocate within a predefined scanning range in the scanning direction along the guide rails 15*a*.

The storage tanks 16 are, for example, removable cartridges. The storage tanks 16 are provided corresponding to kinds of liquids. For example, four storage tanks 16 may be provided to store four kinds of liquids of black, yellow, cyan, and magenta. Each of the liquids is supplied from the corresponding one of the storage tanks 16 to the corresponding one of the image recording heads 11*b*.

The operation section 17 is configured by an input device such as buttons. The operation section 17 is used for the input of printing conditions and the like. The operation section 17 is connected to the controller 20, and information input through the operation section 17 is output to the controller 20.

<Configuration of Controller>

As depicted in FIG. 2, the controller 20 includes a network interface (I/F) 21, a control section 22, and a storage 23. The I/F 21 receives various kinds of data such as printing data, from the operation section 17 and an external apparatus D such as a computer, a camera, a network, and a storage medium. The printing data includes, for example, image data and setting data. The image data indicates an image I to be printed on the paper P and includes color information and gradation information. The setting data includes conditions set for printing, such as a size and orientation of the paper P, a size (magnification, reduction) of the image I, and the like. The setting data may include input information from the operation section 17.

The storage 23 is a memory that is accessible from the control section 22. The storage 23 includes a RAM and a ROM. The RAM temporarily saves various kinds of data. Examples of the various kinds of data include the printing data and data converted by the control section 22. The ROM stores a computer program and a control program for performing various kinds of data processes. The computer program may be obtained from the external apparatus D via the I/F 21, or may be stored in another storage medium.

The control section 22 includes an arithmetic processing unit such as a processor (e.g., CPU). The control section 22 controls respective sections by executing the computer program(s) stored in the ROM, and executes a printing process. For example, the control section 22 executes the first recording mode and the second recording mode. The details of the first recording mode and the second recording mode are explained below.

The controller 20 is electrically connected to driving circuits that drive respective sections. The controller 20 controls the driving of the respective sections by converting the printing data into control data and outputting the control data to the driving circuits. A head driving circuit 25 outputs a driving signal depending on the control data from the controller 20 to the piezoelectric element 11*c* and controls the driving of the piezoelectric element 11*c*. Accordingly, a liquid discharge timing, a liquid discharge amount, and the like depending on the driving of the piezoelectric element 11*c* are controlled, and a position and a size of a dot formed by the liquid are controlled.

Namely, the image data of the printing data includes dot data that defines the presence or absence of the dot for each pixel of a manuscript M. The head driving circuit 25 thus drives the piezoelectric element 11*c* so that liquid is discharged at a discharge timing corresponding to a position of a dot-presence pixel on the manuscript M, thus forming the dot at the position corresponding to the pixel on the paper. Further, on this occasion, the dot having a size depending on the liquid discharge amount is formed. On the other hand, at a discharge timing corresponding to a position of a dot-absence pixel on the manuscript M, the piezoelectric element 11*c* is not driven, and thus no liquid is discharged by the piezoelectric element 11*c*. Thus, no dot is formed at the position corresponding to the pixel on the paper P, and the position is a blank. Accordingly, the manuscript M including the dot-absence data, such as a document, includes an area formed having the dot (image I) and an area formed having no dot (blank). Further, the manuscript M including no dot-absence data, such as a photo, does not include the blank area, and an area for the image I is provided over the entire manuscript M.

A feed driving circuit 26 outputs the driving signal depending on the control data from the controller 20 to the feed motor 13*b*, and controls the driving of the feed motor 13*b*. A conveyance driving circuit 27 outputs the driving signal depending on the control data from the controller 20 to the conveyance motor 14*b*, and controls the driving of the conveyance motor 14*b*. A scanning driving circuit 28 outputs the driving signal depending on the control data from the controller 20 to the scanning motor 15*b*, and controls the driving of the scanning motor 15*b*. Accordingly, a driving timing, a rotation velocity, a rotation amount, and the like of the feed motor 13*b*, the conveyance motor 14*b*, and the scanning motor 15*b* are controlled.

The controller 20 executes a pass including a recording process and a conveyance process. In the recording process, dots are formed on the paper P by discharging liquid droplets from the image recording heads 11*b* during movement in the scanning direction of the image recording heads 11*b*. In the conveyance process, the paper P is conveyed in the conveyance direction. The controller 20 proceeds the printing process by alternately repeating the recording process and the conveyance process, while regarding a pair of the recording process and the conveyance process as one pass.

The printing process may be unidirectional printing (one-side printing) or bidirectional printing. In the unidirectional printing, the recording process is performed when the image recording heads 11*b* move toward one side in the scanning direction. In the bidirectional printing, the recording process is performed when the image recording heads 11*b* move toward one side and the other side in the scanning direction. In the unidirectional printing, a side at which the recording process starts is fixed, for example, one side (e.g., the first side) in the scanning direction. In the bidirectional printing, a side at which the recording process starts alternately changes between one side and the other side (e.g., the first side and the second side that is opposite side of the first side) in the scanning direction. For example, when a side at which the recording process starts is the first side and a side at which the recording process ends is the second side in the k-th pass (k is a natural number), a side at which the recording process starts is the second side and a side at which the recording process ends is the first side in the next (k+1)-th pass.

<First Recording Mode and Second Recording Mode>

In the first recording mode, the image recording heads 11*b* accelerate to the first velocity, move at a constant velocity that is the first velocity, and decelerate from the first velocity. In the first recording mode, the image I is recorded at least during the constant velocity movement at the first velocity. In the second recording mode, the image recording heads 11*b* accelerate to the second velocity that is lower velocity than the first velocity, move at a constant velocity that is the second velocity, and decelerate from the second velocity. In the second recording mode, the image I is recorded at least during the constant velocity movement at the second velocity.

Figure 3:
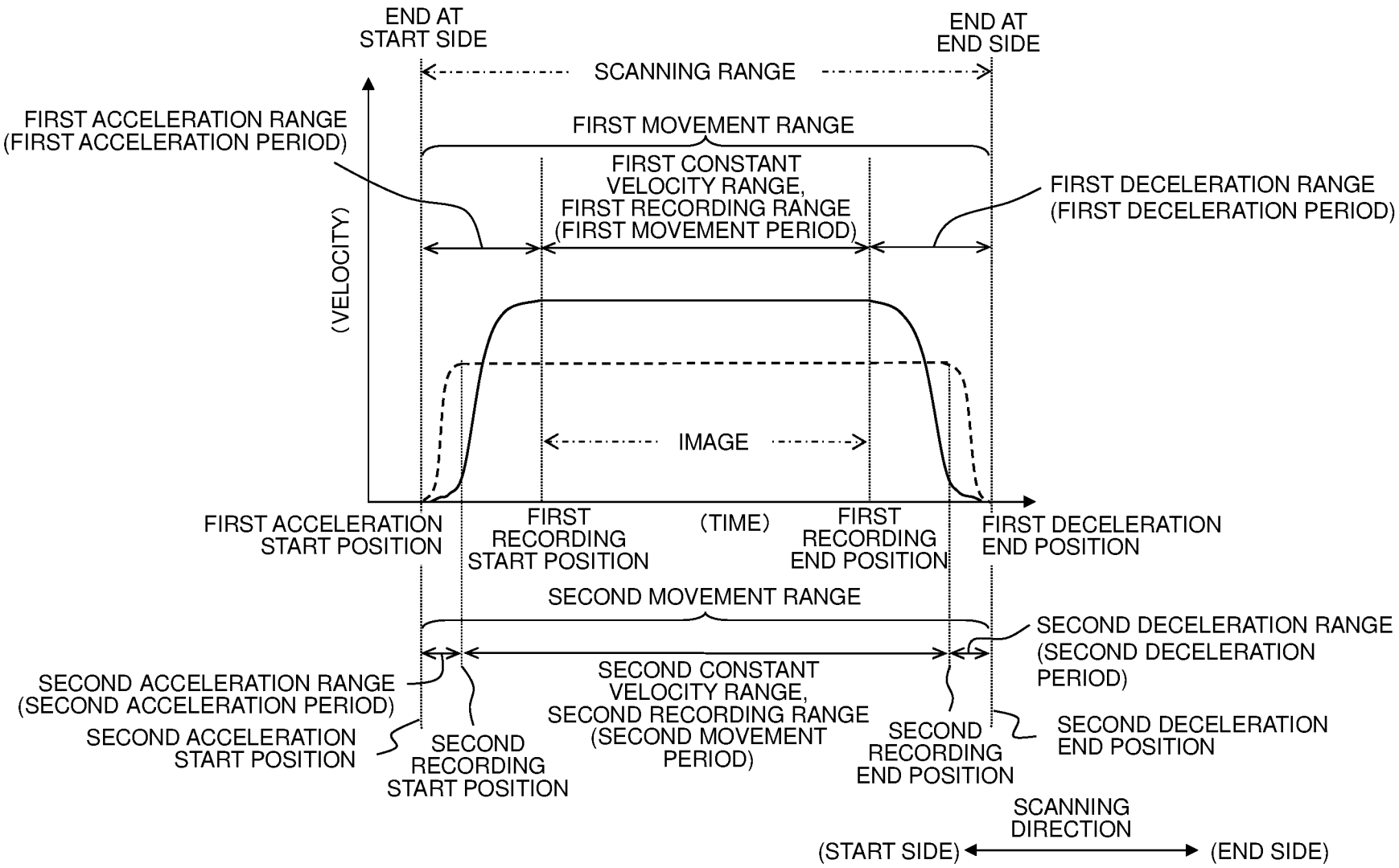
FIG. 3 is a graph indicating moving velocity of the image recording apparatus with respect to time.

Specifically, as depicted in FIGS. 1 and 3, the scanner 15 moves the image recording heads 11*b* within the predefined scanning range in the scanning direction. The scanning range is a predefined maximum range where the carriage 11*a* carrying the image recording heads 11*b* is movable along the two guide rails 15*a*.

In the first recording mode, the image recording heads 11*b*, in the scanning direction, start to accelerate at the first acceleration start position, accelerate from the velocity 0 to the first velocity at the first acceleration rate, move at the constant velocity that is the first velocity, decelerate from the first velocity to the velocity 0 at the first deceleration rate, and end the deceleration at the first deceleration end position and stop there. A range in the scanning direction where the image recording heads 11*b* move during a period during which the image recording heads 11*b* accelerate (first acceleration period) is referred to as the first acceleration range. A range in the scanning direction where the image recording heads 11*b* move during a period during which the image recording heads 11*b* move at the first velocity (first movement period) is referred to as the first constant velocity range. A range in the scanning direction where the image recording heads 11*b* move during a period during which the image recording heads 11*b* decelerate (first deceleration period) is referred to as the first deceleration range. Thus, the first movement range in which the image recording heads 11*b* move in the first recording mode includes the first acceleration range, the first constant velocity range, and the first deceleration range.

Here, the first acceleration rate and the first deceleration rate are determined in advance depending on the first velocity. The first acceleration rate and the first deceleration rate may be constant or change. Thus, in the first recording mode, a curve of velocity that changes with respect to time is a predefined curve. Further, the first acceleration range and the first deceleration range are defined depending on the first velocity. In FIG. 3, the first acceleration rate is the same as the first deceleration rate. The first acceleration rate, however, may be different from the first deceleration rate.

When the image recording heads 11*b* accelerate and reach the first velocity, liquid discharge is started at the first recording start position and recording of the image I is started. Thus, an end of the first constant velocity range at the side of the first acceleration range is the first recording start position.

Then, the image recording heads 11*b* record the image I in the first constant velocity range by discharging liquid while moving at the constant velocity that is the first velocity. This liquid discharge is executed per predefined driving cycle, and thus the dots formed by the discharged liquid are arranged at an interval depending on the driving cycle. Accordingly, the image I is formed by the dots arranged at a regular (constant) interval.

The image recording heads 11*b* end the recording of the image I by ending the liquid discharge at the first recording end position, and decelerate from the first velocity. Thus, an end of the first constant velocity range at the side of the first deceleration range is the first recording end position, and an area between the first recording start position and the first recording end position in the scanning direction is the first recording range in which the image I is recorded in the first recording mode.

In the second recording mode, the image recording heads 11*b*, in the scanning direction, start to accelerate at the second acceleration start position, accelerate from the velocity 0 to the second velocity at the second acceleration rate, move at the constant velocity that is the second velocity, decelerate from the second velocity to the velocity 0 at the second deceleration rate, and end the deceleration at the second deceleration end position and stop there. A range in the scanning direction where the image recording heads 11*b* move during a period during which the image recording heads 11*b* accelerate (second acceleration period) is referred to as the second acceleration range, a range in the scanning direction where the image recording heads 11*b* move during a period during which the image recording heads 11*b* move at the second velocity (second movement period) is referred to as the second constant velocity range, and a range in the scanning direction where the image recording heads 11*b* move during a period during which the image recording heads 11*b* decelerate (second deceleration period) is referred to as the second deceleration range.

Thus, the second movement range in which the image recording heads 11*b* move in the second recording mode includes the second acceleration range, the second constant velocity range, and the second deceleration range. The second acceleration rate and the second deceleration rate are determined in advance depending on the second velocity. The second acceleration rate and the second deceleration rate may be constant or change. Further, the second acceleration rate may be the same as or different from the second deceleration rate. The second acceleration range and the second deceleration range are defined depending on the second velocity.

When the image recording heads 11*b* accelerate and reach the second velocity, recording of the image I is started at the second recording start position and the image I is recorded in the second constant velocity range. Then, the image recording heads 11*b* end the recording of the image I at the second recording end position, and decelerate from the second velocity. Thus, an end of the second constant velocity range at the side of the second acceleration range is the second recording start position, an end of the second deceleration range at the side of the second constant velocity range is the second recording end position, and an area between the second recording start position and the second recording end position is the second recording range.

In each of the recording modes, a velocity changing distance is longer and a velocity changing range is larger as the velocity during the constant velocity movement is higher. The change in velocity includes acceleration and deceleration in which velocity changes, and the velocity changing range includes the respective acceleration ranges and the respective deceleration ranges. Thus, the first acceleration range (first acceleration period) is longer than the second acceleration range (second acceleration period). The first deceleration range (first deceleration period) is longer than the second deceleration range (second deceleration period).

Thus, as depicted in FIG. 3, when the first movement range is equal to the second movement range, the first constant velocity range is narrower than the second constant velocity range. Since the first movement range can not be set to be larger than the scanning range, the first constant velocity range is longest when the first movement range is equal to the scanning range.

Figure 4:
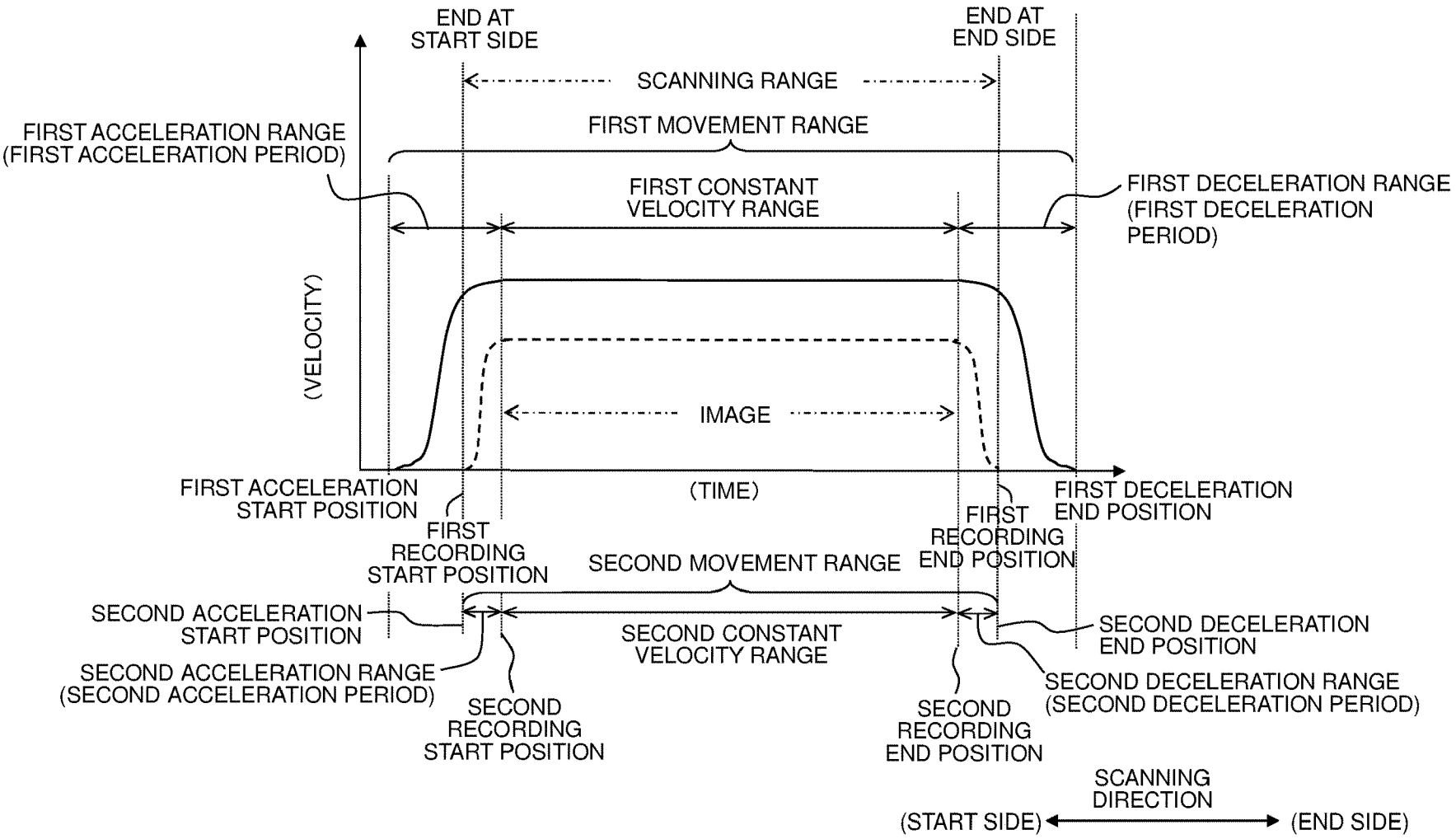
FIG. 4 is a graph indicating moving velocity of the image recording apparatus with respect to time when image recording is to be performed during the first velocity changing period.

When an image I larger than the longest first constant velocity range is to be printed as depicted in FIG. 4, the image I is to be formed in the first velocity changing range (first acceleration range and first deceleration range). When liquid is discharged by the image recording heads 11*b* in the first velocity changing range per a predefined driving cycle, an interval between dots formed by the discharged liquid changes as the velocity changes. This decreases the quality of the image I formed by dots.

Thus, the control section 22 changes the recording mode from the first recording mode to the second recording mode, and performs printing in the second constant velocity range (second recording range) longer than the first constant velocity range (first recording range). Namely, the control section 22 divides printing data into data for each pass, and when the control section 22 has determined based on the printing data for the k-th pass that the image I is to be recorded in the first velocity changing period, the control section 22 executes the second recording mode instead of the first recording mode for the k-th pass.

For example, when at least one of the two following cases is satisfied in the first recording mode, the control section 22 determines that the image I is to be recorded during the first velocity changing period. The two cases are a case in which the acceleration start position (first acceleration start position) where the image recording heads 11*b* accelerate to reach the first velocity at the recording start position (first recording start position) is outside the scanning area, and a case in which the deceleration end position (first deceleration end position) where the image recording heads 11*b* at the first velocity decelerate from the recording end position (first recording end position) and stop is outside the scanning range.

Namely, as depicted in FIGS. 3 and 4, the control section 22 sets the first constant velocity range to a length in the scanning direction of the image I. When the first movement range is equal to or less than the scanning range, the first constant velocity range may be set to be longer than the length in the scanning direction of the image I.

As depicted in FIG. 3, the first acceleration start position is a position shifted from the first recording start position, that is one end of the first constant velocity range, by a predefined first acceleration range toward a side (start side) of the first recording start position opposite from the other end (end side) of the first constant velocity range. The first deceleration end position is a position shifted from the first recording end position, that is the other end of the first constant velocity range, by a predefined first deceleration range toward a side (end side) of the first recording end position opposite from the one end (start side) of the first constant velocity range. When the first acceleration start position and the first deceleration start position are within the scanning range, the first movement range is within the scanning range. In this case, since the image is to be recorded in the first constant velocity range, printing is to be performed by the first recording mode.

On the other hand, as depicted in FIG. 4, when the first acceleration start position and the first deceleration start position are outside the scanning range, the first movement range is longer than the scanning range. In this case, when the first movement range is set within the scanning range, image recording is to be performed during the first velocity changing period. Thus, printing is to be performed by the second recording mode instead of the first recording mode. In this case, the second constant velocity range is set to the length of the image I. When the second movement range is equal to or less than the scanning range, the second constant velocity range may be set to be longer than the length in the scanning direction of the image I.

The second acceleration start position is a position shifted from the second recording start position, that is one end of the second constant velocity range, by a predefined second acceleration range toward the start side. The second deceleration end position is a position shifted from the second recording end position, that is the other end of the second constant velocity range, by a predefined second deceleration range toward the end side. The second acceleration start position and the second deceleration start position are within the scanning range.

<Control Method of Image Recording Apparatus>

Figure 5A:
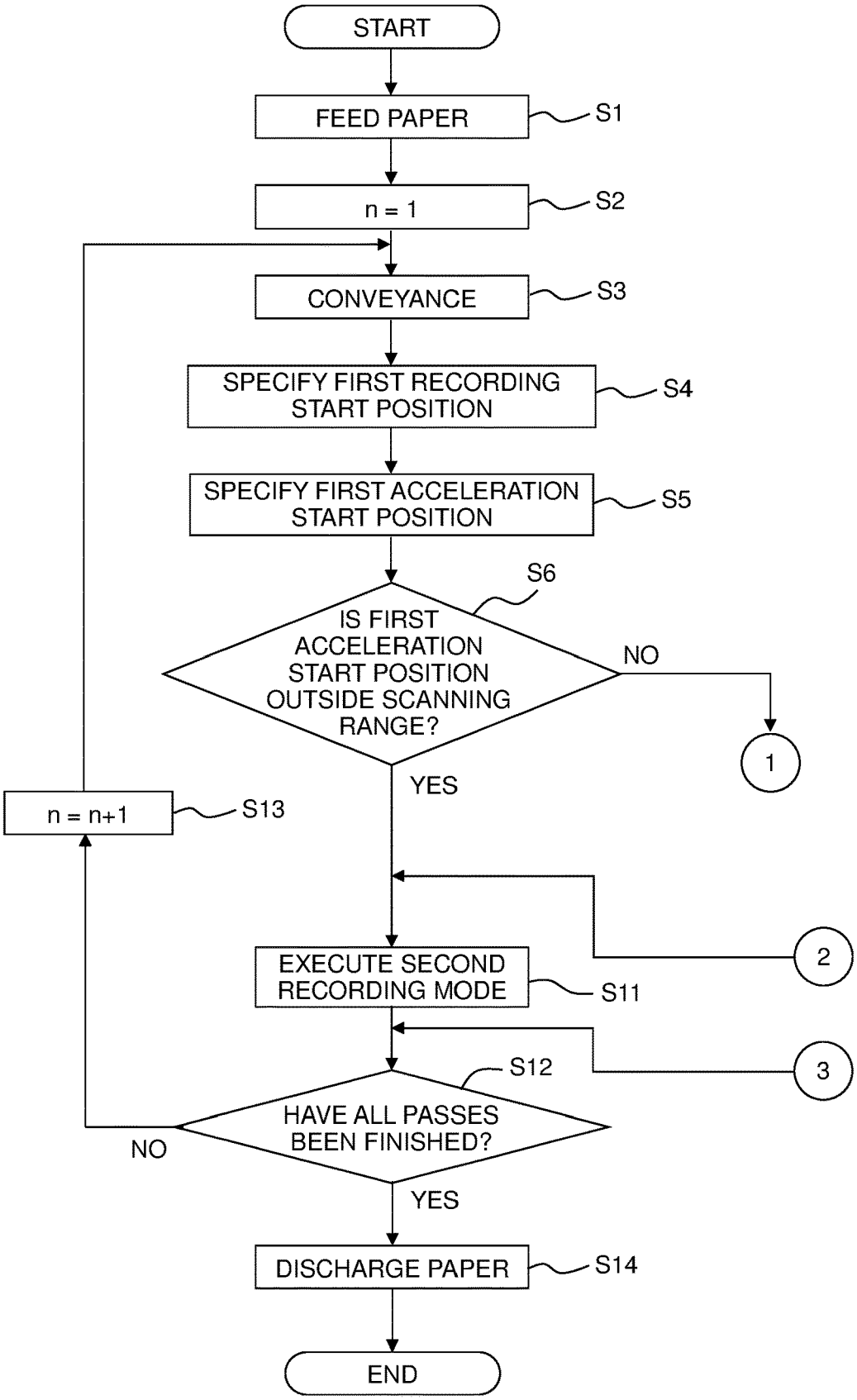
FIGS. 5A and 5B depict a flowchart indicating an exemplary control method performed by the image recording apparatus in FIG. 1.
Figure 5B:
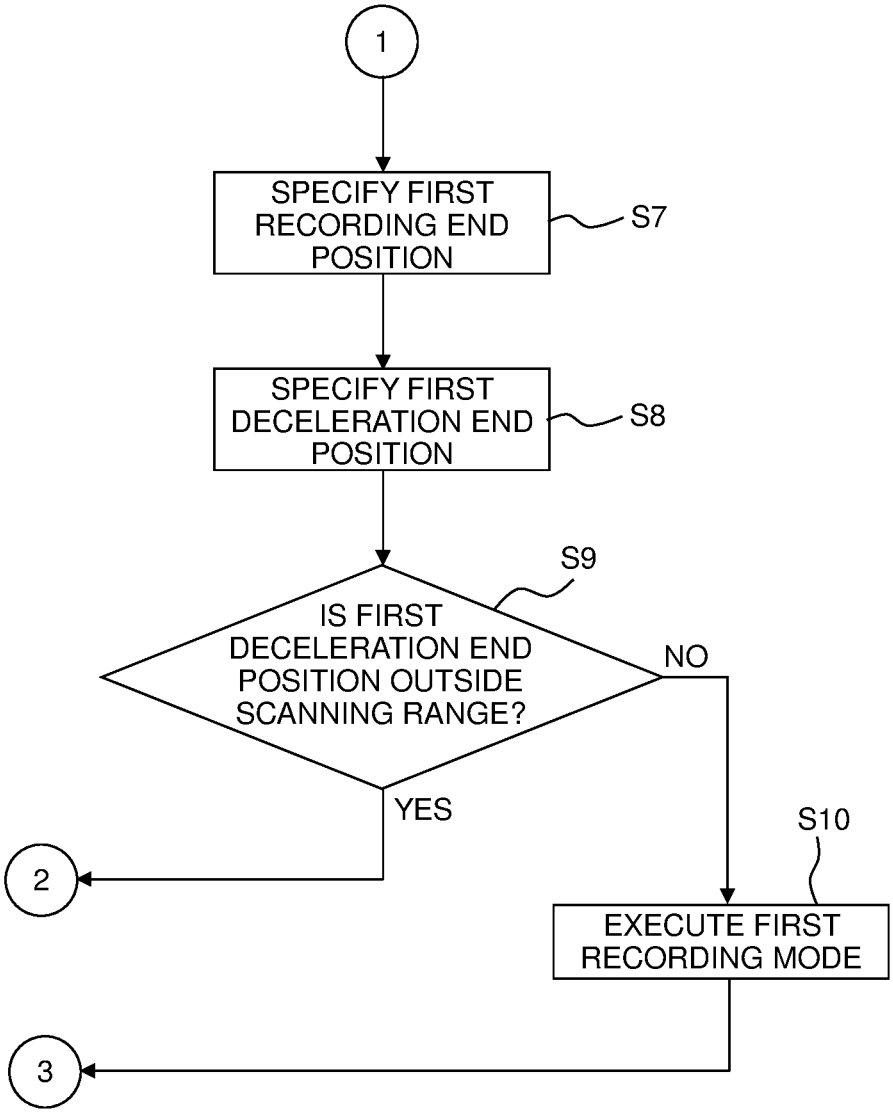
Figure 6A:
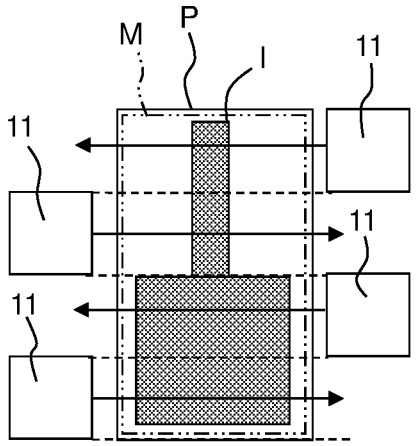
FIGS. 6A, 6B and 6C each depict an image to be recorded on paper.

A control method of the image recording apparatus 10 according to this embodiment is performed by causing the control section 22 to execute a computer program by which the image recording apparatus 10 is operated in accordance with the flowchart in FIGS. 5A and 5B. As depicted in FIG. 6A, explanation is made about a case where an image I is to be recorded on the paper P based on printing data of the manuscript M. In the following, the positions of the manuscript M, the image I, the scanning range, and the image recording heads 11*b* are explained as coordinate positions with respect to a predefined position in the image recording apparatus 10.

At first, the control section 22 obtains the printing data and starts the printing process. In the printing process, the control section 22 drives the feed motor 13*b* by the feed driving circuit 26 to rotate the feed roller 13*a* brought into contact with the paper P, thereby feeding the paper P from the feed tray 13*c* to a predefined position on the platen 12 (step S1). The paper P moves in the conveyance direction along a guide or the like. The paper P is arranged so that a center portion in the scanning direction of the paper P is coincident with a center portion of the scanning range. Further, the control section 22 obtains the manuscript M from image data of the printing data, and specifies a position of the manuscript M with respect to the paper P depending on setting data of the printing data.

Subsequently, the control section 22 resets n to 1 (step S2), divides the printing data into data for each pass, and obtains an image I (the n-th pass image) to be printed in the n-th pass of the manuscript M, from the printing data of the n-th pass (the n-th pass data) (n is a natural number). Then, the control section 22 drives the conveyance motor 14*b* by the conveyance driving circuit 27 so that the position of the n-th pass image with respect to the paper P in the conveyance direction is a position based on the printing data, and conveys the fed paper P on the platen 12 (step S3).

The control section 22 specifies, from the n-th pass data, a position of a dot that is at an end at the start side in the scanning direction of the n-th pass image, as the first recording start position (step S4). Then, the control section 22 specifies the first acceleration start position that is separated from the first recording start position toward the start side by the predefined first acceleration range (step S5). Further, for example, the control section 22 controls so that a predefined position in the scanning direction of the manuscript M (e.g., center portion) is coincident with a predefined position (e.g., center portion) of the scanning range, and sets the position of the manuscript M with respect to the scanning range. Accordingly, the first recording start position of the n-th pass image in the manuscript M is set with respect to the scanning range, and the first acceleration start position based on the first recording start position can be compared with the scanning range.

The control section 22 determines whether the first acceleration start position is outside the scanning range (step S6). A position at the start side (start-side end) of the scanning range or a position at the end side (end-side end) of the scanning range is predefined with respect to the image recording apparatus 10. The control section 22 determines that the first acceleration start position is within the scanning range (step S6: NO) when the first acceleration start position is positioned at the start-side end or between the start-side end and the end-side end.

The control section 22 specifies, from the n-th pass data, a position of a dot that is at an end at the end side in the scanning direction of the n-th pass image, as the first recording end position (step S7). Then, the control section 22 specifies the first deceleration end position that is separated from the first recording end position toward the end side in the scanning direction by the predefined first deceleration range (step S8). Then, the control section 22 determines whether the first deceleration end position is outside the scanning range (step S9).

When the first deceleration start position is positioned at the end-side end or between the start-side end and the end-side end, the control section 22 determines that the first deceleration end position is within the scanning range (step S9: NO). Then, the control section 22 executes the first recording mode based on the n-th pass data (step S10). In this configuration, the recording process for discharging liquid is performed in the first constant velocity range without being performed in the first velocity changing range to form the n-th pass image. The quality of the image I is thus not decreased. Further, since the image recording heads 11*b* move at the first velocity higher than the second velocity, printing can be performed fast.

In the step S6, when the first acceleration start position is outside the scanning range (step S6: YES) or when the first deceleration end position is outside the scanning range (step S9: YES), the control section 22 determines that the recording of the n-th pass image is to be performed during the first velocity changing period. Then, the control section 22 executes the second recording mode based on the n-th pass data (step S11). In this configuration, since the moving velocity of the image recording heads 11*b* is reduced from the first velocity to the second velocity, the recording range is increased from the first constant velocity range to the second constant velocity range. Thus, the recording process is performed in the second constant velocity range instead of in the first velocity changing range to form the n-th pass image on the paper P. Accordingly, printing during the velocity changing period is inhibited without increasing the scanning range, thereby inhibiting a decrease in image quality as well as an increase in size of the apparatus.

After the control section 22 starts the execution of the first recording mode or the second recording mode for the first pass (steps S10 and S11), the control section 22 determines whether all the passes based on the printing data have been finished (step S12). When a pass to be executed is left (step S12: NO), the control section 22 increments n by one (n=n+1) (step S13), and returns to the process of the step S3. Then, the control section 22 executes processes of the steps S3 to S12 for the n-th (=k+1) pass next to the n-th (=k) pass. When all the passes to be executed have been executed (step S12: YES), the control section 22 discharges the paper P on the platen 12 by use of the conveyance roller 14*a* (step S14), and ends the printing process.

First Modified Example

In the image recording apparatus 10 according to the first modified example, when a range (first movement range) obtained by adding an acceleration range (first acceleration range) in which the image recording heads 11*b* move during the first acceleration period and a deceleration range (first deceleration range) in which the image recording heads 11*b* move during the first deceleration period to a recording range (first recording range) between a recording start position (first recording start position) and a recording end position (first recording end position) is longer than the scanning range, the control section 22 determines that an image I is to be recorded during the first velocity changing period.

Specifically, as depicted in FIGS. 3 and 4, the control section 22 specifies a length in the scanning direction of the image I from printing data, and sets the length in the scanning direction of the image I to a length of the first recording range. Then, the control section 22 calculates a length of the first movement range by adding a predefined length of the first acceleration range and a predefined length of the first deceleration range to a length of the first recording range. When the length of the first movement range is equal to or less than the length of the scanning range, the length of the first recording range may be longer than the length of the image I.

As depicted in FIG. 3, when the length of the first movement range is equal to or shorter than the length of the scanning range, it is possible to record the image I in the first constant velocity range. The control section 22 thus determines that the recording of the image I is not to be performed during the first velocity changing period, and executes the first recording mode. On the other hand, when the length of the first movement range is longer than the length of the scanning range as depicted in FIG. 4, the recording of the image I is to be performed during the first velocity changing period. The control section 22 thus determines that the recording of the image I is to be performed during the first velocity changing period, and executes the second recording mode.

As described above, the first recording mode or the second recording mode is selected by comparing the length of the scanning range and the length of the first movement range in which the image recording heads 11*b* move by the first recording mode. Accordingly, in the first recording mode, the velocity can be increased without a decrease in quality of the image I. Further, in the second recording mode, a decrease in image quality can be inhibited while inhibiting an increase in size of the apparatus.

Second Modified Example

In the flowchart of FIGS. 5A and 5B, when the image I is to be recorded by the plurality of passes, the recording mode is selected and executed for each pass. On the other hand, in the image recording apparatus 10 according to the second modified example, in a case that an image I is to be recorded by a plurality of passes, if the second recording mode has been executed for a certain pass instead of the first recording mode, then the second recording mode will be executed for all the passes to be executed after the certain pass.

Figure 7A:
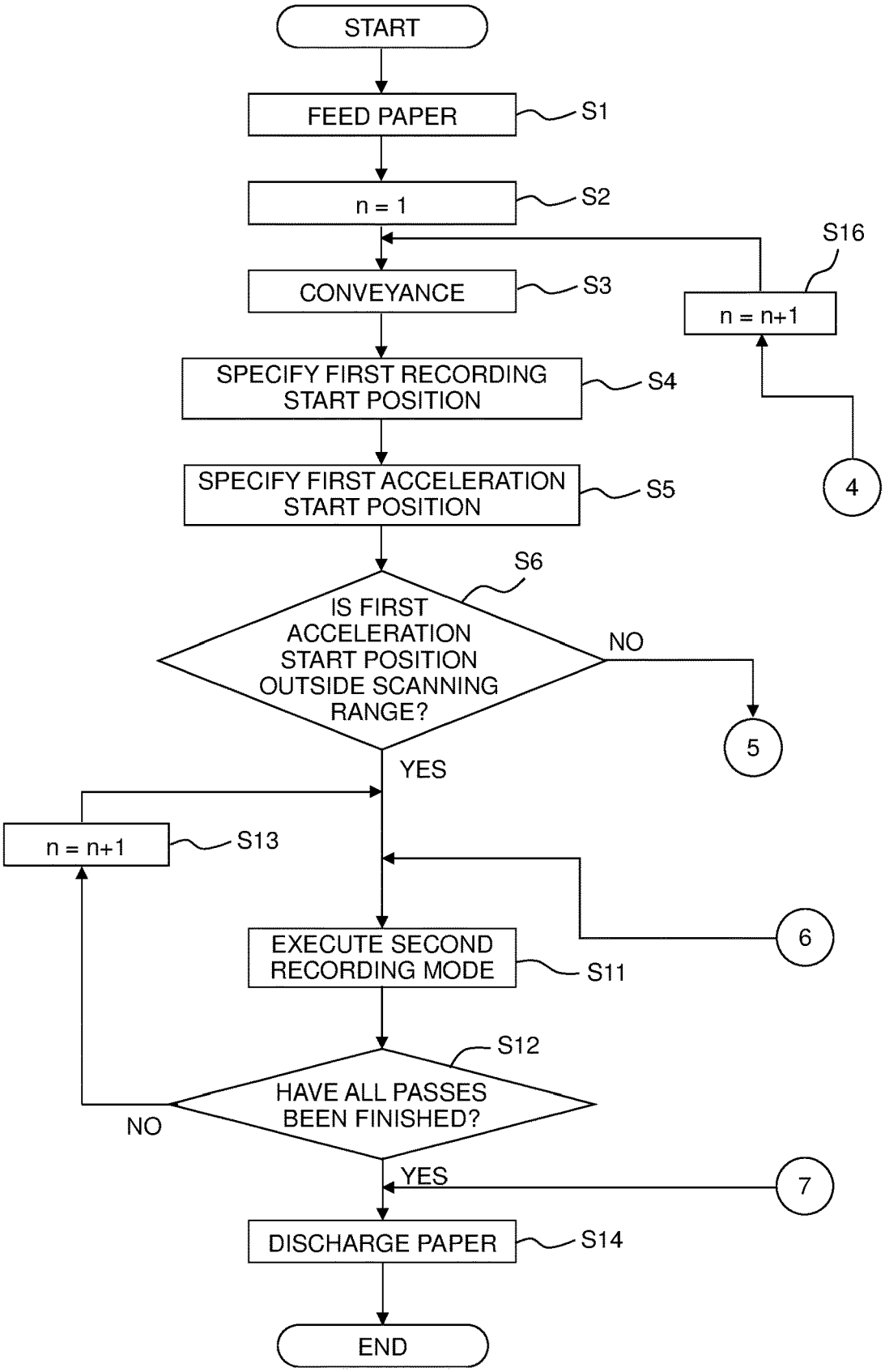
FIGS. 7A and 7B depict a flowchart indicating an exemplary control method performed by the image recording apparatus according to the second modified example of the present disclosure.
Figure 7B:
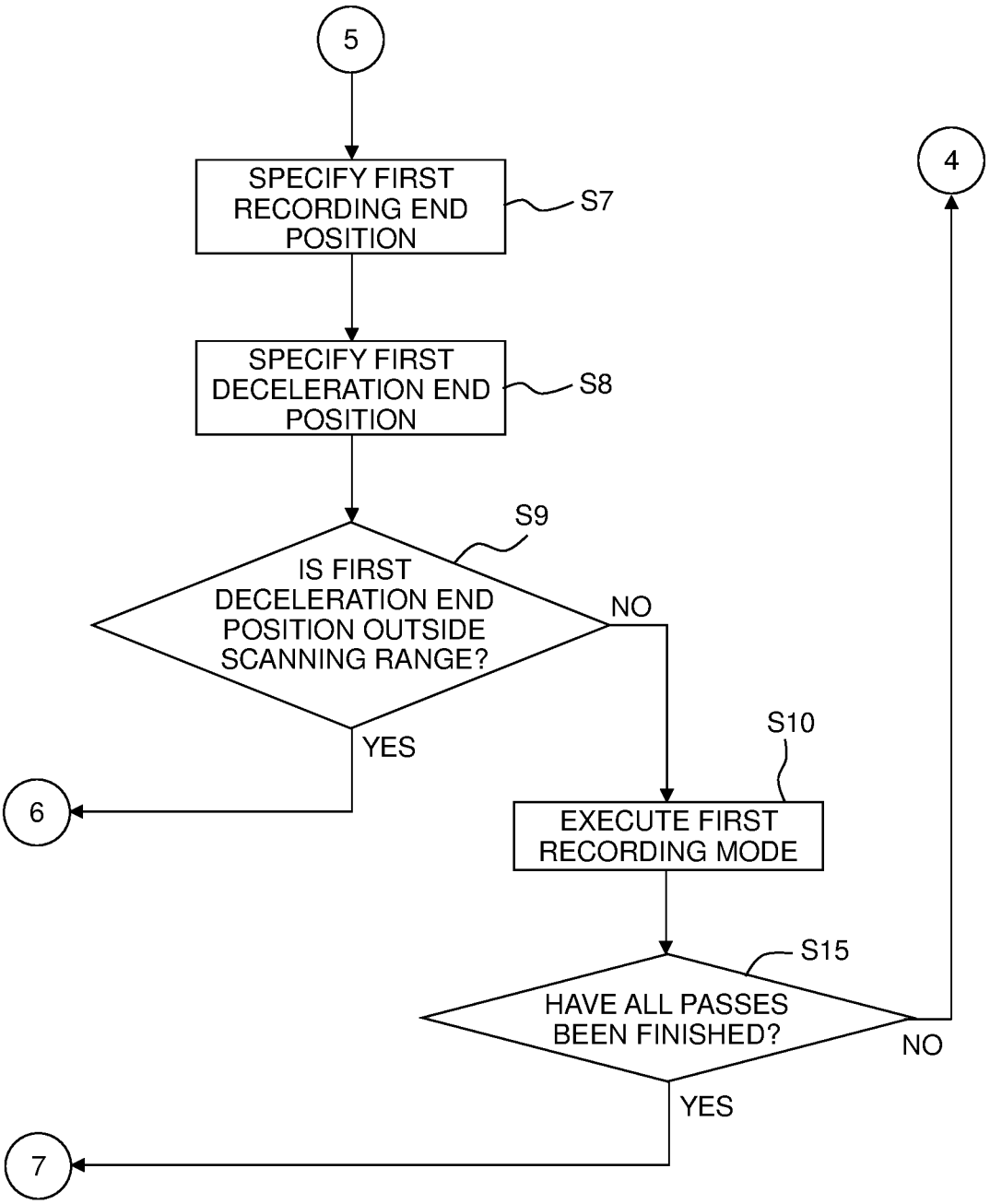

For example, a method for controlling the image recording apparatus 10 of the second modified example is executed by the control section 22 in accordance with the flowchart in FIGS. 7A and 7B. As indicated in FIGS. 7A and 7B, the process of the step S11 is executed after the step S13 indicated in FIGS. 5A and 5B, and the processes of the steps S15 and S16 are executed between the step S10 and the step S14.

Namely, the control section 22 executes the first recording mode (step S10) for the n-th (=k) pass. When all the passes have been finished (step S15: YES), the control section 22 discharges the paper P (step S14). On the other hand, when all the passes have not been finished (step S15: NO), the control section 22 increments n by one (step S16), returns to the step S3, and executes the processes of the step S3 to S9 for the (k+1)-th pass that is next to the k-th pass. All the passes executed before the k-th pass are executed by the first recording mode.

When the first acceleration start position for the (k+1)-th pass is outside the scanning range (step S6: YES), or when the first deceleration end position for the (k+1)-th pass is outside the scanning range (step S9: YES), the control section 22 determines that the recording of the image I is to be performed during the first velocity changing period. Then, the control section 22 executes the second recording mode based on the (k+1)-th pass data (step S11). When all the passes have been finished (step S12: YES), the control section 22 discharges the paper P (step S14).

When a pass to be executed is left (step S12: NO), the control section 22 increments n by one (step S13). Then, the control section 22 executes the second recording mode for the passes after the (k+1)-th pass executed by the second recording mode.

Accordingly, the first recording mode is executed for all the passes before the k-th pass, and the image corresponding to the first pass to the image corresponding to the k-th pass are recorded by the first recording mode. All the passes after the (k+1)-th pass are executed by the second recording mode, and images corresponding to passes after the (k+1)-th pass are recorded by the second recording mode. Accordingly, it is possible to form pass images, each of which continue before or after the switching of the recording mode, using the same recording mode by continuing the second recording mode after the recording mode is switched from the first recording mode to the second recording mode. This reduces a decrease in image quality due to the switching of the recording mode.

Third Modified Example

In the image recording apparatus 10 according to the third modified example, when the control section 22 records an image I included in a recording medium (paper P) by a plurality of passes in the conveyance direction, the control section 22 determines for each pass whether the image I is to be recorded during the first velocity changing period. When the control section 22 has determined that the image I is to be recorded during the first velocity changing period in at least one pass included in the plurality of passes, the control section 22 executes in the plurality of passes for the recording medium (paper P) instead of the first recording mode.

Figure 6C:
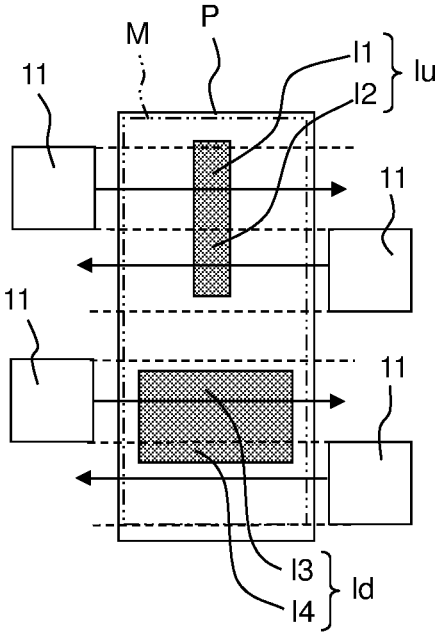
Figure 6B:
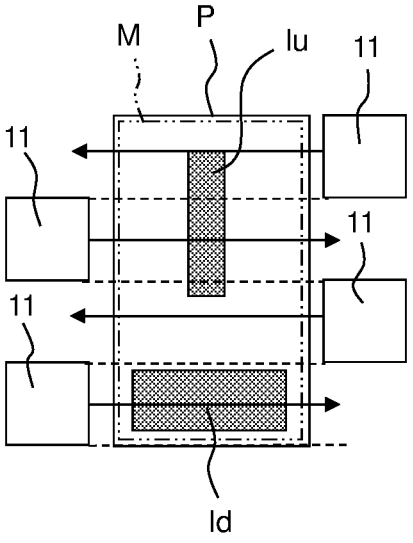

The image I included in the paper P may be an image I to be printed on one paper P. The image I included in the paper P may be one continuous image I as depicted in FIG. 6A, or a plurality of images I separated from each other in the conveyance direction as depicted in FIG. 6B. When an image I larger than the paper P is to be printed, the image I included in the paper P is part of the image I that is larger than the paper P and is to be printed on the paper P.

Figure 8A:
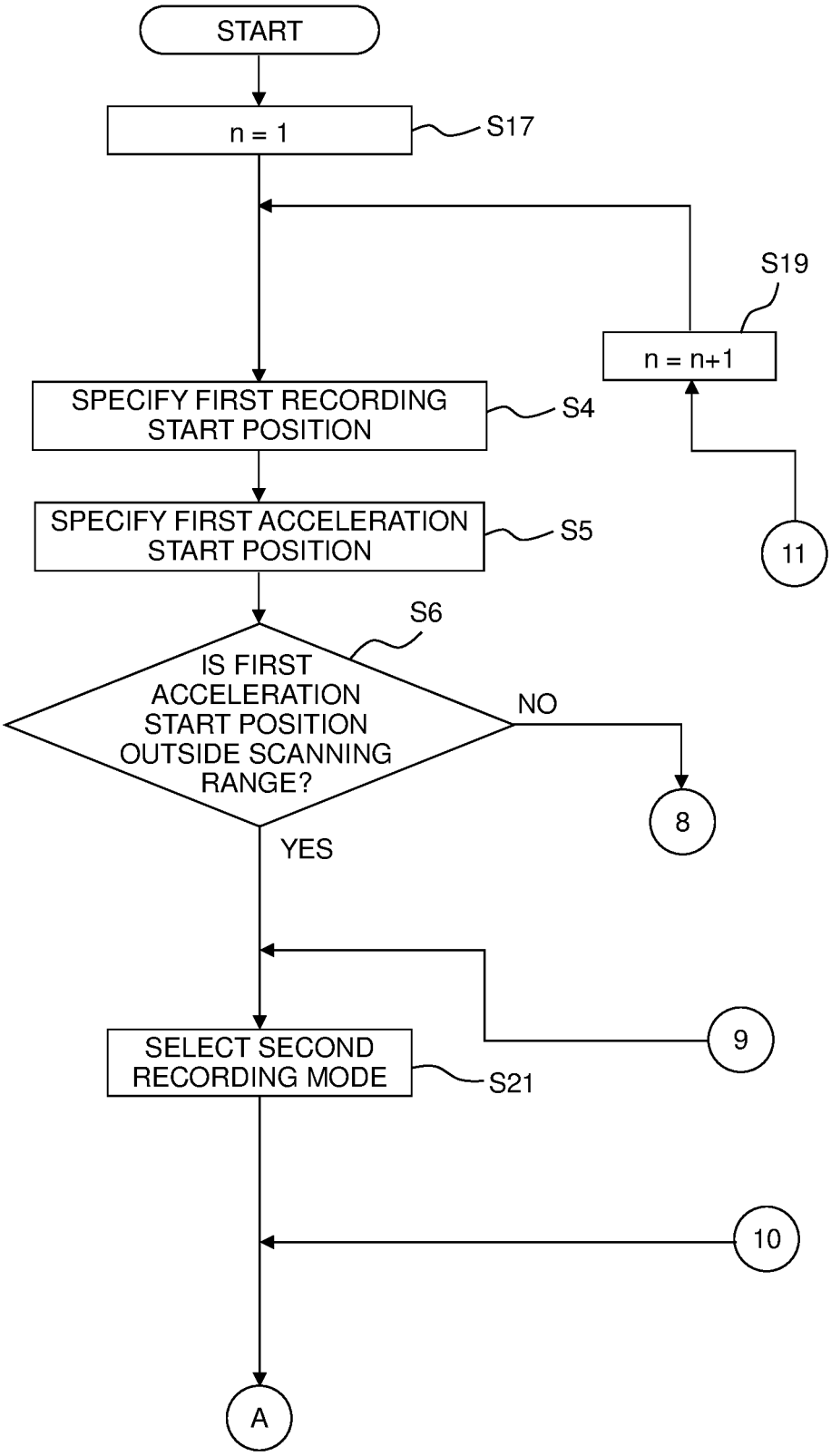
FIGS. 8A and 8B depict part of a flowchart indicating an exemplary control method performed by the image recording apparatus according to the third modified example of the present disclosure.
Figure 8B:
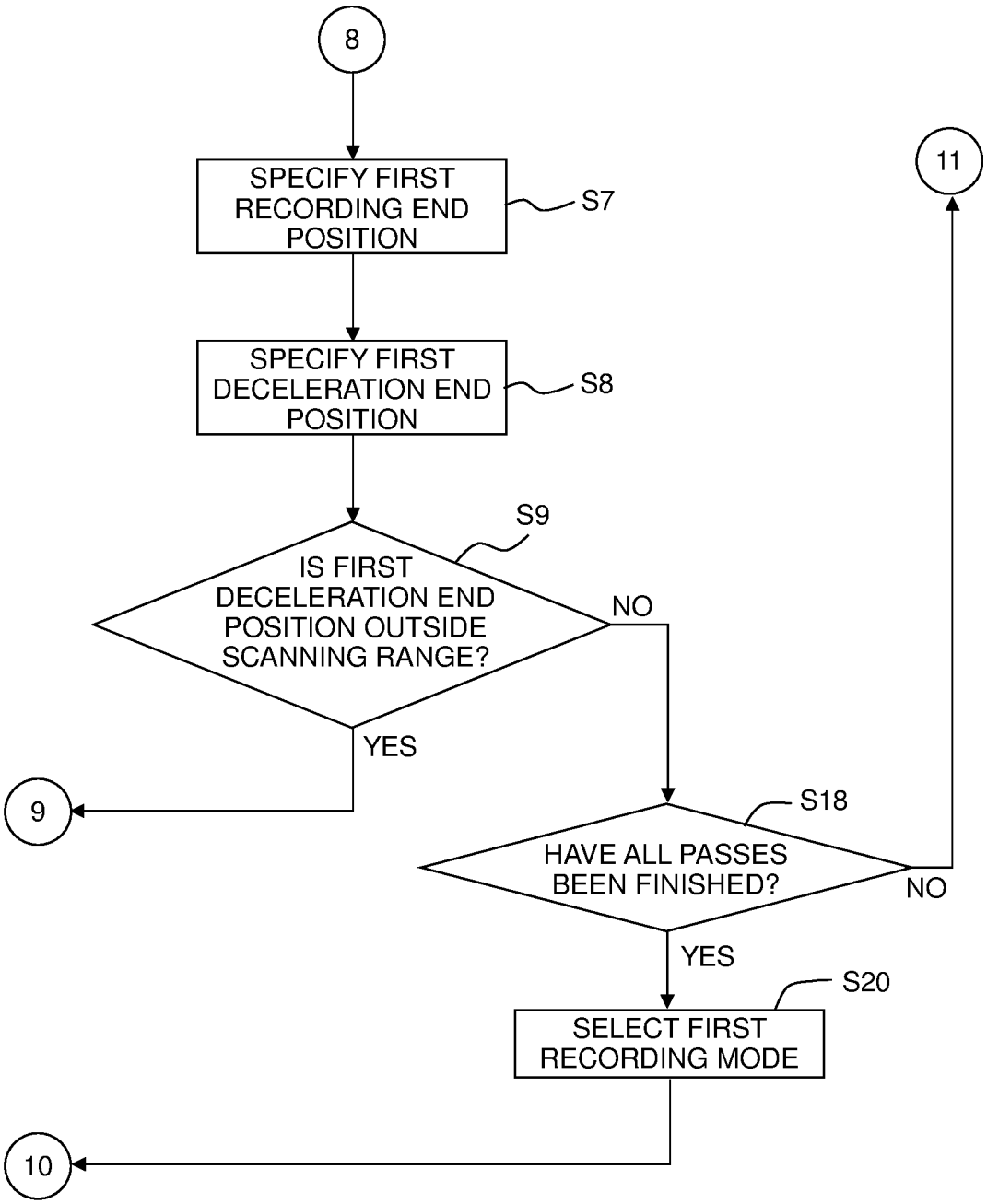
Figure 9:
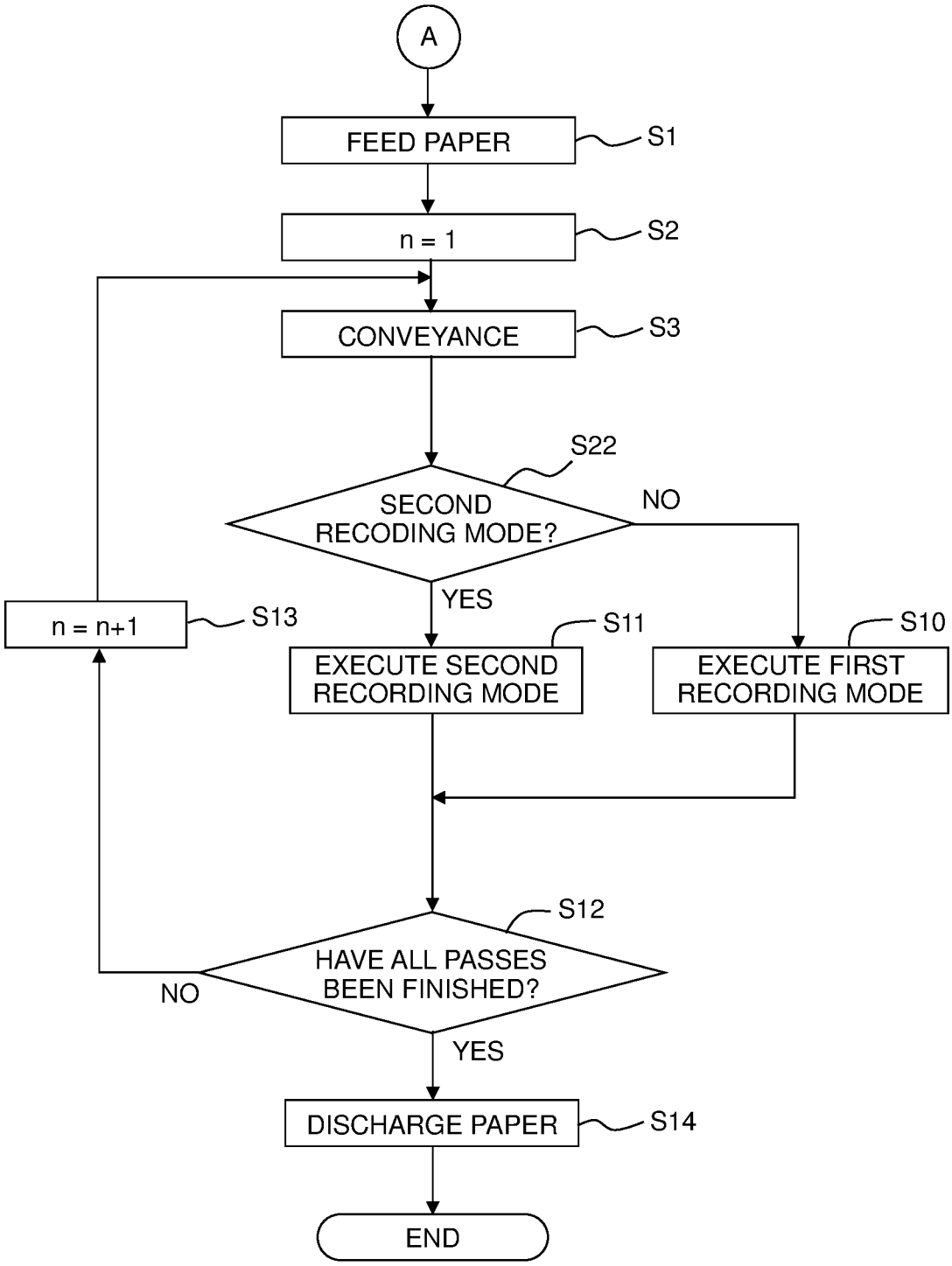
FIG. 9 is part of the flowchart indicating the exemplary control methods performed by the image recording apparatuses according to the third to fifth modified examples of the present disclosure.

For example, a method for controlling the image recording apparatus 10 of the third modified example is executed by the control section 22 in accordance with the flowcharts indicated in FIGS. 8A, 8B and 9. As indicated in FIGS. 8A, 8B and 9, the process of the step S17 is executed before the step S4 indicated in FIGS. 5A and 5B, the process of the step S21 is executed after the step S6, the processes of the steps S18 to S20 are executed after the step S9, the processes of the steps S1 to S3 are executed after the steps S20 and S21, and the process of the step S22 is executed between the step S3 and the steps S10, S11.

Namely, the control section 22 resets n to 1 (step S17), and obtains printing data. Then, the control section 22 obtains a manuscript M from the printing data, and adjusts a predefined position of the manuscript M to a predefined position of the scanning range. The control section 22 specifies the first recording start position of the n-th pass image from the n-th pass data obtained by dividing the printing data into data for each pass (step S4). The control section 22 specifies the first acceleration start position that is separated from the first recording start position toward the start side by the predefined first acceleration range (step S5), and determines whether the first acceleration start position is outside the scanning range (step S6).

When the first acceleration start position is within the scanning range (step S6: NO), the control section 22 specifies the first recording end position for the n-th pass image from the n-th pass data (step S7), specifies the first deceleration end position that is separated from the first recording end position toward the end side in the scanning direction by the predefined first deceleration range (step S8), and determines whether the first deceleration end position is outside the scanning range (step S9). When the first deceleration start position is within the scanning range (step S9: NO), the control section 22 determines whether the determination process in the steps S4 to S9 has been finished for all the passes forming the image I included in the paper P (step S18). For example, although two images I are included in the paper P in FIG. 6B, the images I included in the same paper P are processed integrally. Thus, the control section 22 determines whether the determination process has been performed for the first pass to the fourth pass.

When a pass to be subjected to the determination process is left (step S18: NO), the control section 22 increments n by one (step S19), and executes the determination process for the next pass. When the determination process has been finished for all the passes (step S18: YES), the first acceleration start positions and the first deceleration end positions for all the passes for recording the image I included in the paper P are positioned within the scanning range. The control section 22 thus selects the first recording mode for the all the passes (step S20).

On the other hand, when the first acceleration start position is outside the scanning range (step S6: YES), or when the first deceleration end position is outside the scanning range (step S9: YES), the control section 22 determines that the recording of the image I is to be performed during the first velocity changing period in at least one pass from among all the passes for recording the image I included in the paper P. Then, the control section 22 selects the second recording mode for all the passes (step S21).

When the first recording mode or the second recording mode is selected for recording the whole image (the whole of the images) I included in the paper P as described above, the control section 22 feeds the paper P by use of the feed motor 13*b* (step S1), resets n to 1 (step S2), and conveys the paper P by use of the conveyance motor 14*b* based on the n-th pass data (step S3). Then, the control section 22 determines whether the recording mode selected is the second recording mode (step S22). When the first recording mode is selected (step S22: NO), the control section 22 executes the first recording mode for the n-th pass data (step S10) to form the n-th pass image. On the other hand, when the second recording mode is selected (step S22: YES), the control section 22 executes the second recording mode for the n-th pass data (step S11) to form the n-th pass image.

When a pass to be executed is left (step S12: NO), the control section 22 increments n by one (step S13) and executes the conveyance process of S3 and the recording process including S22 and S10 to S11 for the next pass. As described above, when the conveyance process and the recording process are executed for all the passes (step S12: YES), the control section 22 discharges the paper P (step S14).

As described above, when the control section 22 has determined that the recording of the image I is to be performed during the first velocity changing period in at least one pass from among the passes for recording the whole image (the whole of the images) I included in the paper P (step S6: YES, S9: YES), the second recording mode is executed instead of the first recording mode for all the passes (step S11). Accordingly, the same recording mode is used for one image I or the entirety of the images I included in the paper P. This unifies the image quality in the paper P, thus inhibiting the deterioration in image quality.

Fourth Modified Example

In the image recording apparatus 10 according to the fourth modified example, when one image I is to be recorded by a plurality of passes in the conveyance direction, the control section 22 determines for each pass whether the recording of the image I is to be performed during the first velocity changing period. When the control section 22 has determined that the image I is to be recorded during the first velocity changing period in at least one pass from among the passes, the second recording mode is executed instead of the first recording mode for the passes forming the image I.

One image I is an aggregate of dots of which interval in the conveyance direction is less than a predefined value. For example, in FIG. 6A, dots are continuously arranged in the conveyance direction at an interval that is less than the predefined value. The dots in FIG. 6A are thus one image I. On the other hand, in FIG. 6B, two aggregates of dots of which interval in the conveyance direction is less than the predefined value are formed, and the interval between the two aggregates is equal to or more than the predefined value. The two aggregates are thus two images (upstream image Iu and downstream image Id).

A conveyance distance of the paper P is uniformly set in advance so that, in the conveyance direction, an image formable range for the k-th pass makes contact with or partially overlaps with an image formable range for the (k+1)-th pass next to the k-th pass. Explanation is made below about a case in which two images I separated from each other by not less than the predefined value are formed by continuous passes by which the paper P is conveyed by the uniform conveyance distance.

Figure 10A:
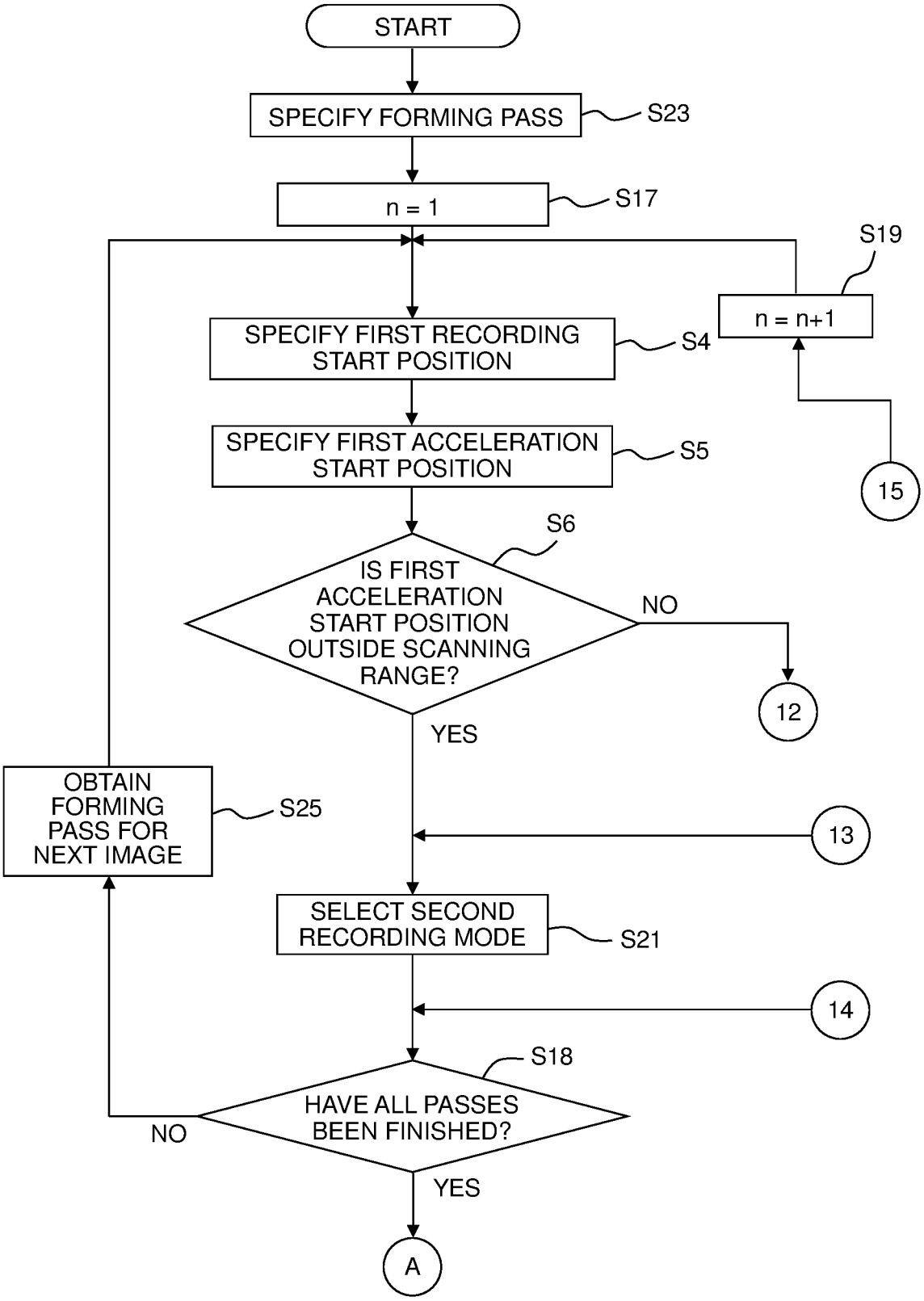
FIGS. 10A and 10B depict part of a flowchart indicating an exemplary control method performed by the image recording apparatus according to the fourth modified example of the present disclosure.
Figure 10B:
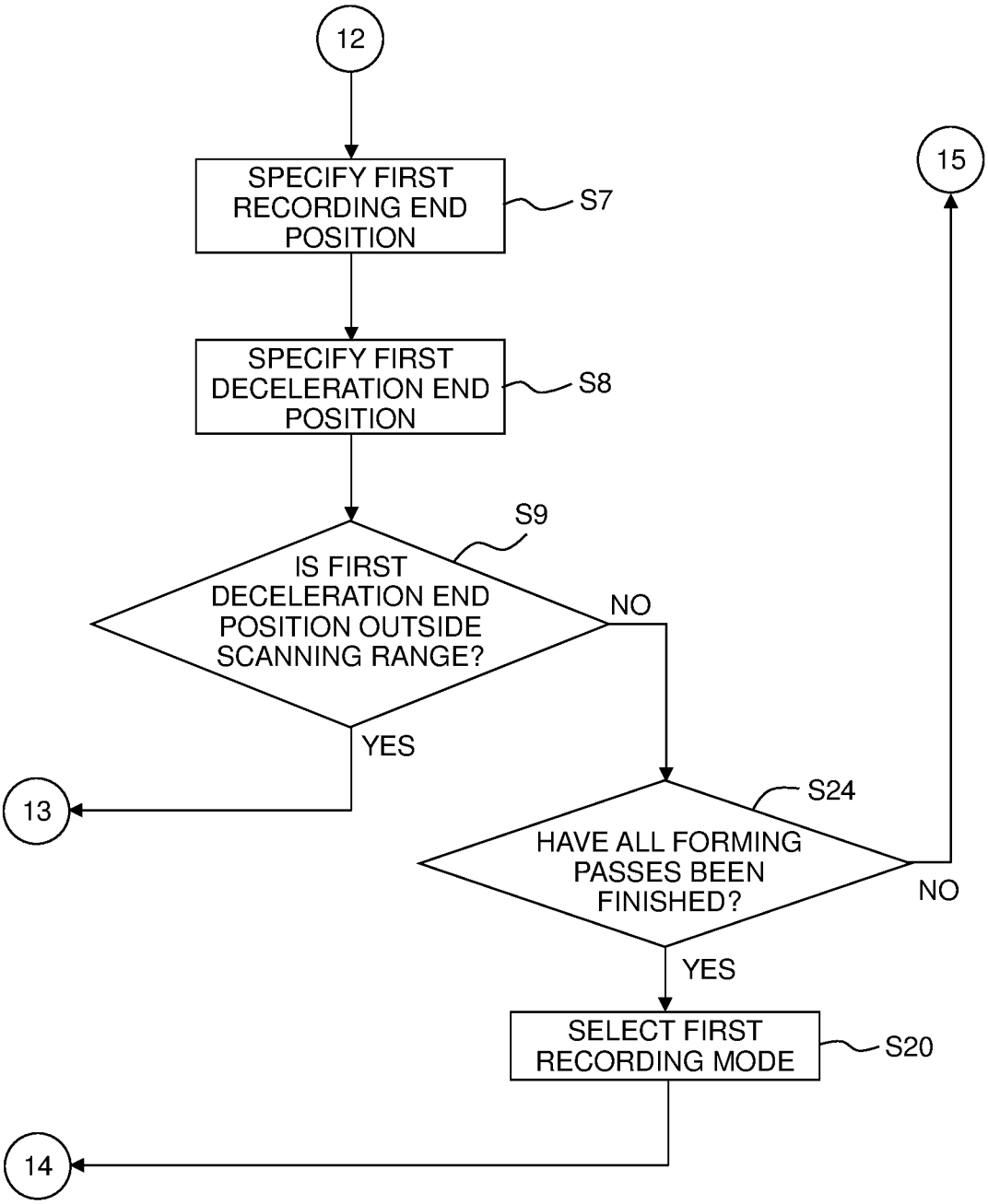

For example, a method for controlling the image recording apparatus 10 of the fourth modified example is executed by the control section 22 in accordance with flowcharts indicated in FIGS. 9, 10A and 10B. As indicated in FIGS. 9, 10A and 10B, a process of the step S23 is executed before the step S17 indicated in FIGS. 8A, 8B and 9, a process of the step S24 is executed after the step S9, and a process of the step S25 is executed between the step S18 and the step S4.

Specifically, the control section 22 specifies, from printing data, positions of images I included in a manuscript M, determines images I separated from each other in the conveyance direction by not less than the predefined value as different images I, and specifies passes for forming the respective images I. For example, in FIG. 6B, the control section 22 associates passes for forming the upstream image Iu (forming pass for the upstream image Iu) with the first pass and the second pass, and associates passes for forming the downstream image Id (forming pass for the downstream image Id) with the third pass and the fourth pass.

Then, the control section 22 executes, for each image I, a selection process of the recording mode in the steps S17, S4 to S9, S19 to S21, and S24. In the step S24, the control section 22 determines whether all the passes for forming one image I (forming pass for one image I) have been finished. When all the passes for forming one image I have not been finished (step S24: NO), the control section 22 increments n by one (step S19), returns to the step S4, and executes the selection process for the image I. When all the passes for forming one image I have been finished (step S24: YES), the control section 22 selects the first recording mode for the image I (step S20). When the control section 22 has determined that the recording of the image I is to be performed during the first velocity changing period in at least one pass from among the passes for forming one image I (step S6: YES, step S9 YES), the control section 22 selects the second recording mode for the image I (step S21).

As described above, when the recording mode is selected for one image I (steps S20 and S21), and when all the passes have not been finished (step S18: NO), the control section 22 obtains passes associated with passes for the next image I (step S25). Then, the control section 22 executes the selection process for the passes for the next image I by starting the selection process for the first pass from thereamong.

When the selection process has been finished for all the passes (step S18: YES), the control section 22 feeds the paper P (step S1). Then, the image I is formed by the first recording mode or the second recording mode from the upstream image Iu to the downstream image Id in the conveyance direction through the conveyance process of the step S3 and the recording process including S22 and S10 to S13 (step S12: NO). When the entire image I is formed by finishing all the passes (step S12: YES), the control section 22 discharges the paper P (step S14).

As described above, when the control section 22 has determined that the recording of the image I is to be performed during the first velocity changing period in at least one pass from among the passes for forming one image I (step S6: YES, S9: YES), the second recording mode is executed for all the passes instead of the first recording mode (steps S11 and S21). This unifies the image quality and the recording mode for each image I, thus inhibiting the deterioration in image quality.

Fifth Modified Example

In the image recording apparatus 10 according to the fifth modified example, the control section 22 determines, for each image I arranged at an interval of not less than a predefined value, whether the image I is to be recorded during the first velocity changing period.

In FIG. 6B, the two images I separated from each other by not less than the predefined value are formed by the continuous passes in which the paper P is conveyed by the uniform conveyance distance. On the other hand, in FIG. 6C, the conveyance distance of the paper P is set based on a position in the conveyance direction of the image I. The control section 22 thus executes the determination process for each image I based on a connection of pass images in the conveyance direction on the basis of the conveyance distance.

Figure 11A:
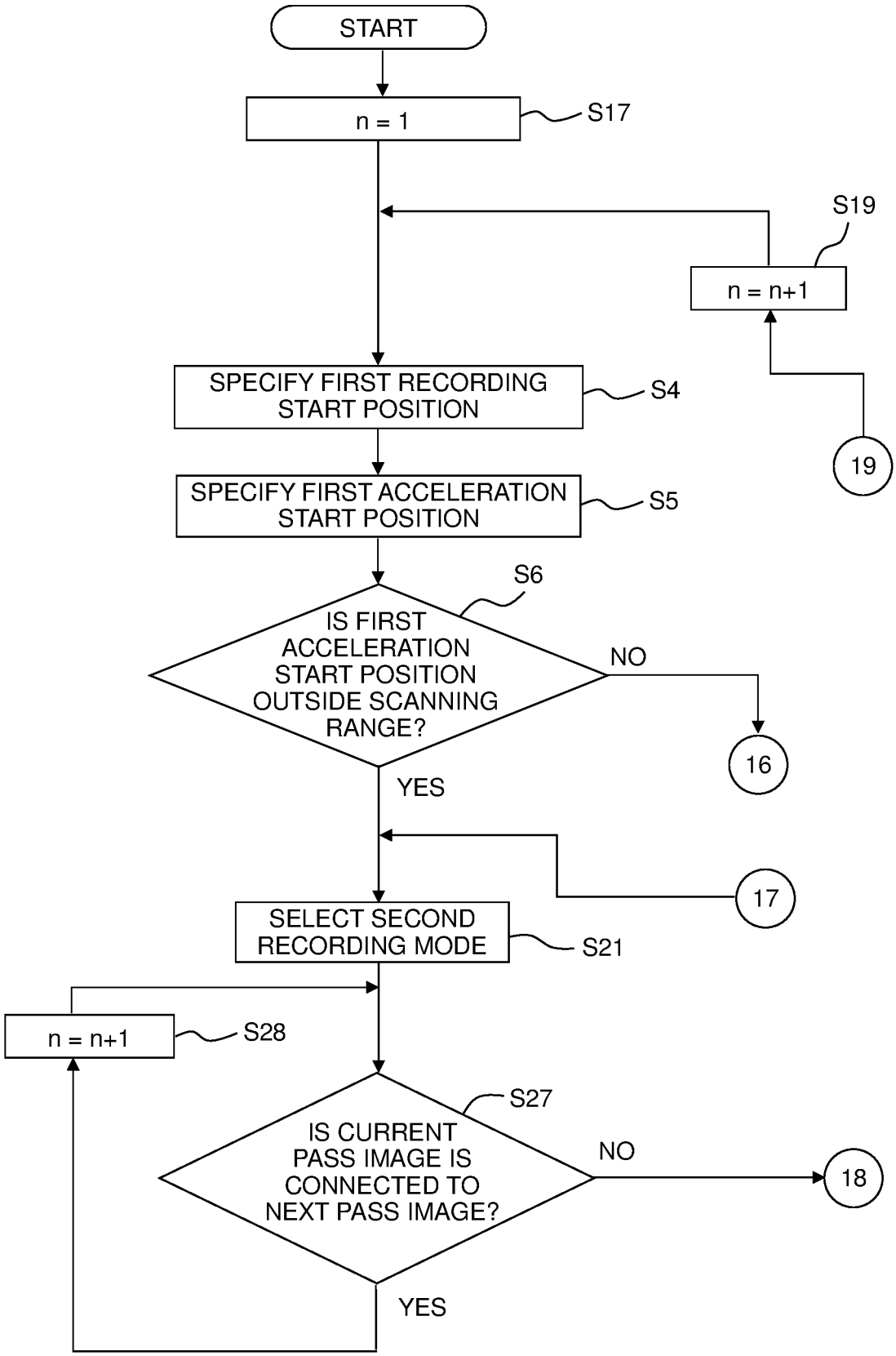
FIGS. 11A and 11B depict part of a flowchart indicating an exemplary control method performed by the image recording apparatus according to the fifth modified example of the present disclosure.
Figure 11B:
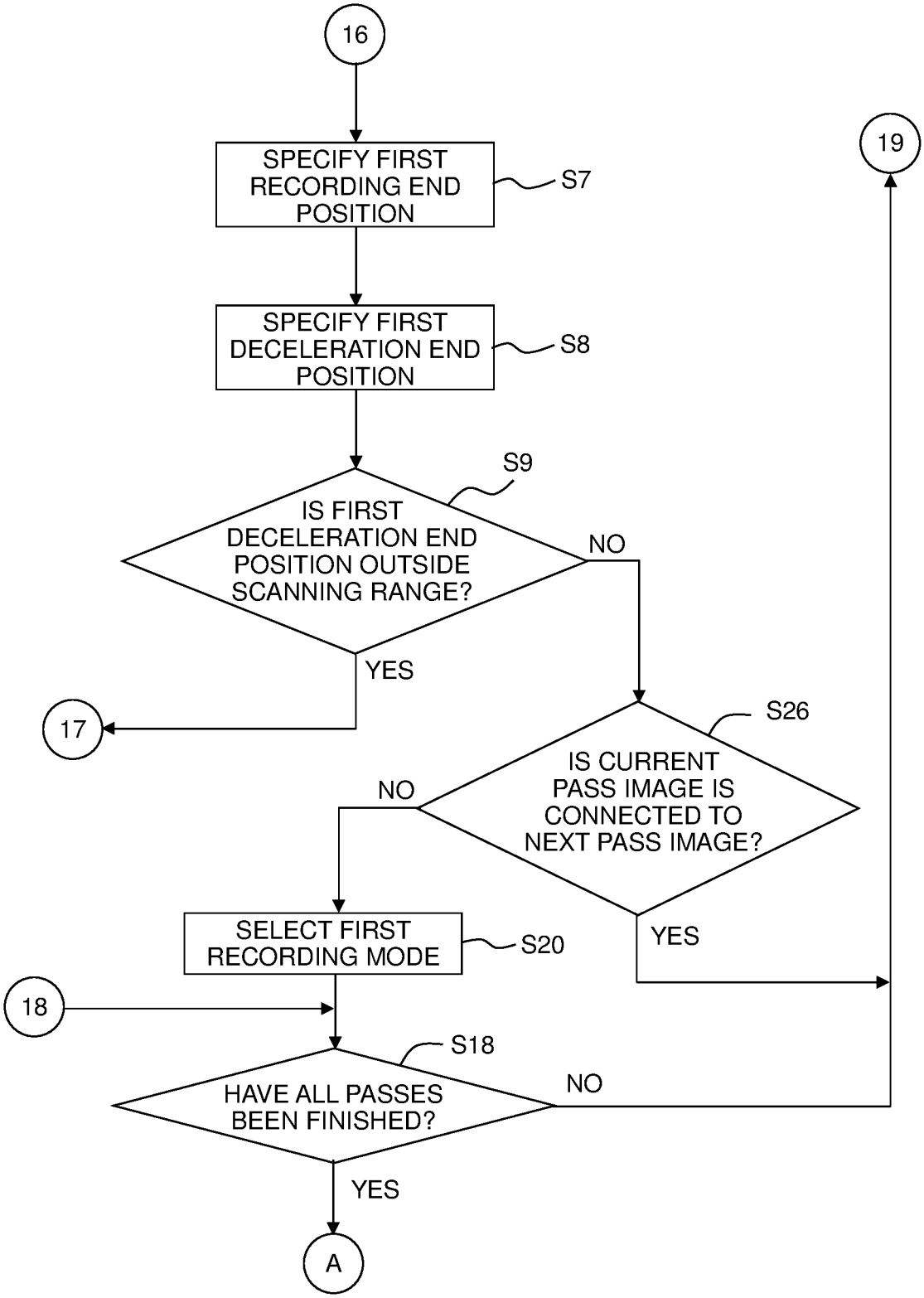

For example, a method for controlling the image recording apparatus 10 of the fifth modified example is executed by the control section 22 in accordance with the flowcharts indicated in FIGS. 9, 11A and 11B. As indicated in FIGS. 9, 11A and 11B, a process of the step S26 is executed between the step S9 and the step S19 indicated in FIGS. 8A, 8B and 9, and processes of steps S27 and S28 are executed after the step S21.

Specifically, the control section 22 resets n (step S17), obtains a position of an image I based on dot data of printing data, and divides the printing data into data for each pass so that the image I is divided into pass images in the conveyance direction. Thus, a distance over which the paper P is conveyed by the conveyer 14 (FIG. 1) between the n-th (=k) pass and the n-th (=k+1) pass is set based on an interval between a downstream end in the conveyance direction of the k-th pass image formed by the k-th pass and an upstream end in the conveyance direction of the (k+1)-th pass image formed by the next (k+1)-th pass.

Then, the control section 22 determines whether image recording is to be performed during the first velocity changing period in the steps S4 to S9 for the n-th pass data. When image recording is not to be performed during the first velocity changing period (step S6: NO, step S9: NO), the control section 22 determiners whether the current pass image is connected to the next pass image in the conveyance direction (step S26).

When the conveyance distance between the k-th pass and the (k+1)-th pass is less than a predefined distance, the control section 22 determines that the interval in the conveyance direction between the k-th pass image and the (k+1)-th pass image is less than the predefined value and the current pass image is connected to the next pass image in the conveyance direction (step S26: YES). In the case of FIG. 6C, the interval in the conveyance direction between the first pass image I1 and the second pass image I2 is less than the predefined value, and the first pass image I1 is connected to the second pass image I2 to form one upstream image Iu. Thus, the conveyance distance between the first pass and the second pass is less than the predefined distance, and the control section 22 determines that the first pass image I1 is connected to the second pass image I2. Then, the control section 22 increments n by one (step S19), returns to the step S4, and executes the processes after the step S4 for the next pass.

On the other hand, when the conveyance distance between the current pass and the next pass is equal to or more than the predefined distance, the control section 22 determines that the interval in the conveyance direction between the current pass image and the next pass image is equal to or more than the predefined value and the current pass image is not connected to the next pass image in the conveyance direction (step S26: NO). In the example of FIG. 6C, since the second pass image I2 is separated from the third pass image I3 in the conveyance direction by not less than the predefined value, the second pass image I2 is not connected to the third pass image I3 in the conveyance direction and the determination process for the upstream image Iu including the second pass image I2 ends. Thus, the control section 22 selects the first recording mode for the first pass and the second pass for forming one upstream image Iu (step S20).

Then, the control section 22 determines whether the processes for all the passes for the printing data have been finished (step S18). When a pass to be processed is left (step S18: NO), the control section 22 increments n by one (step S19), returns to the step S4, and executes the processes of the steps S4 to S9 for the next pass. When image recording is to be performed for the n-th pass data during the first velocity changing period (step S6: YES, S9: YES), the second recording mode is selected for one image I including the n-th pass image corresponding to the n-th pass data (step S21).

For example, in the example of FIG. 6C, the interval between the third pass image I3 and the fourth pass image I4 is less than the predefined value in the conveyance direction, and the third pass image I3 is connected to the fourth pass image I4 to form one downstream image Id. When image recording is to be performed during the first velocity changing period in at least one pass included in a plurality of passes for forming the downstream image Id, the second recording mode is selected for all the passes for forming the downstream image Id. Thus, when image recording is to be performed by the third pass during the first velocity changing period (step S6: YES, S9: YES), no determination process is required for the remaining fourth pass. The control section 22 thus determines whether the third pass image I3 is connected to the fourth pass image I4 in the conveyance direction (step S27). In the example of FIG. 6C, since the third pass image I3 is connected to the fourth pass image I4 (step S27: YES), the control section 22 increments n by one (step S28) and determines the connection of pass images in the conveyance direction for the next pass (step S27).

When the control section 22 determines that the current pass image is not connected to the next pass image in the conveyance direction (step S27: NO), the control section 22 determines whether all the passes have been finished (step S18). When the selection process has been finished for all the passes (step S18: YES), the control section 22 executes the steps after the step S1 of FIG. 9.

As described above, the control section 22 determines whether the recording of the image I is to be performed during the first velocity changing period for each image I arranged at the interval of not less than the predefined value. By doing so, one image I is recorded by the same recording mode. In this case, even in a case where images I that are adjacent to each other are formed by different recording modes, if the images I are arranged with a gap, the difference in image quality is inconspicuous. Accordingly, the decrease in image quality is inhibited.

Sixth Modified Example

Figure 12:
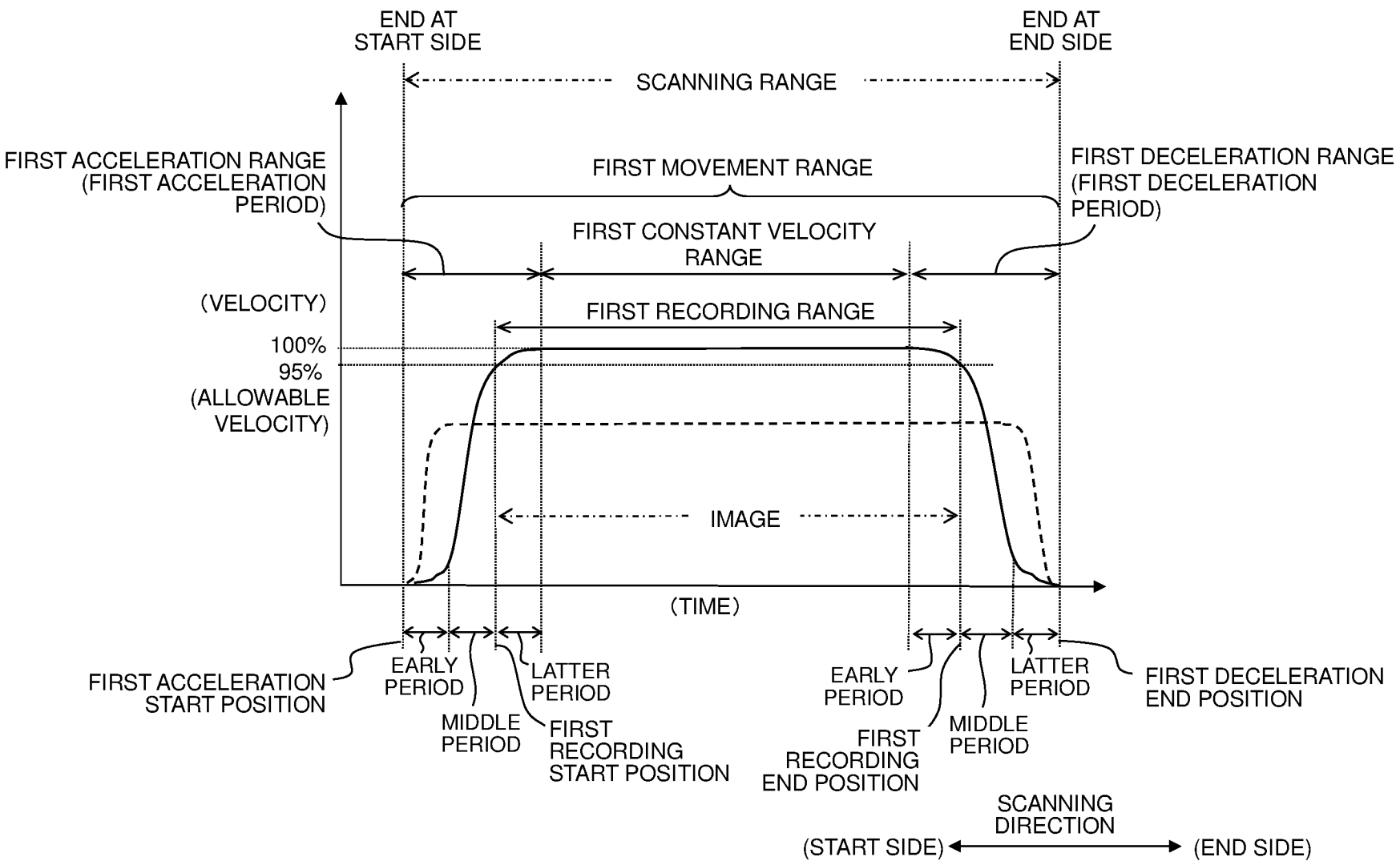
FIG. 12 is a graph indicating moving velocity of the image recording apparatus according to the sixth modified example of the present disclosure with respect to time.

As depicted in FIG. 12, in the image recording apparatus 10 according to the sixth modified example, when the control section 22 has determined that recording of an image I is to be performed during at least one of a period included in the first acceleration period and during which the velocity of the image recording heads 11*b* reaches an allowable velocity that is lower than the first velocity and a period included in the first deceleration period and during which the velocity of the image recording heads 11*b* decreases from the allowable velocity, the control section 22 executes the second recording mode instead of the first recording mode. For example, in this situation, the allowable velocity may be higher than the second velocity and lower than the first velocity. The allowable velocity may be, for example, 95% of the first velocity.

Namely, as depicted in FIG. 12, when the first acceleration range is divided into three portions (early period, middle period, and latter period), the velocity change in the early period and the latter period is smaller than that in the middle period. Thus, the change in the interval of dots formed by the image recording heads 11*b* in the early period and the latter period is smaller than that in the middle period regardless of the acceleration of the image recording heads 11*b*. Accordingly, the latter period close to the first constant velocity range, for example, a period during which the moving velocity changes from the allowable velocity to the first velocity is included in the first recording range. In this case, even when dots are formed in the latter period, the decrease in image quality can be inhibited. Further, since the first recording range is widened, printing can be performed by the first recording mode also on paper P having a larger size.

Similarly, when the first deceleration range is divided into three portions (early period, middle period, and latter period), the velocity change in the early period and the latter period is smaller than that in the middle period. Thus, the change in the interval of dots formed by the image recording heads 11*b* in the early period and the latter period is smaller than that in the middle period regardless of the deceleration of the image recording heads 11*b*. Accordingly, the early period close to the first constant velocity range, for example, a period during which the moving velocity changes from the first velocity to the allowable velocity is included in the first recording range. In this case, even when dots are formed in the early period of the first deceleration range, the decrease in image quality can be inhibited. Further, since the first recording range is widened, printing can be performed by the first recording mode also on paper P having a larger size.

Seventh Modified Example

In the image recording apparatus 10 according to the seventh modified example, the control section 22 makes resolution of an image I by the second recording mode higher than resolution of the image I by the first recording mode. Namely, since the second velocity of the second recording mode is lower than the first velocity of the first recording mode, the resolution can be increased by reducing an interval of dots. Accordingly, it is possible to perform high-velocity printing by the first recording mode, and perform high-quality printing by the second recording mode. This results in different characteristics of the recording modes.

Second Embodiment

In the image recording apparatus 10 according to the second embodiment of the present disclosure, when borderless printing forming no margin around an image I is set, and when a recording medium is larger than a predefined size, the control section 22 determines that the image I is to be recorded during the first velocity changing period.

For example, as depicted in FIGS. 2 and 13, a user operates the operation section 17 to set the printing quality, the presence or absence of margin, and the size of the paper P to be printed, as printing conditions. Then, the printing conditions are output to the control section 22 as setting data of printing data. The size of the paper P to be printed is obtained by a sensor or the like configured to detect the size of the paper P to be fed, and the size of the paper P to be printed may be included in the setting data.

The control section 22 obtains the setting data. When a high quality is designated as the printing quality, the control section 22 executes the second recording mode irrespectively of the presence of absence of margin and the size of the paper P. In this case, the resolution in the scanning direction for printing is, for example, 1200 dpi that is not less than a predefined resolution.

When a standard quality is designated as the printing quality and the bordered printing is to be performed, the control section 22 executes the first recording mode regardless of the size of the paper P. Further, even when the standard quality is designated as the printing quality and the borderless printing is to be performed, the control section 22 executes the first recording mode provided that the size of the paper P is not more than the predefined size, such as those except for A4 size or a letter size. In this case, the resolution in the scanning direction for printing is, for example, 600 dpi that is less than the predefined resolution.

On the other hand, when the borderless printing is to be performed and the size of the paper P is larger than the predefined size such as the A4 and the letter size, the control section 22 executes the second recording mode even when the standard quality is designated as the printing quality. Namely, when the standard quality is designated as the printing quality, an interval of dots is large and printing can be performed at the first velocity of which velocity is high. However, when the borderless printing is to be performed, a size of the image is large because printing is performed beyond ends of the paper P (i.e., printing is performed also for the outside of the paper P). Further, when the size of the paper P is larger than the predefined size, the size of the image to be printed on the paper P is large. Thus, the control section 22 determines that recording of the image I is to be performed during the first velocity changing period, and executes the second recording mode instead of the first recording mode.

Other Embodiments

In all the embodiments, the length of the first acceleration range (first acceleration period) may be the same as the length of the second acceleration range (second acceleration period). Further, the length of the first deceleration range (first deceleration period) may be the same as the length of the second deceleration range (second deceleration period).

In all the embodiments, when the control section 22 has determined that image recording is to be performed during the first acceleration period and the first deceleration period, the control section 22 may execute the second recording mode instead of the first recording mode.

All the above embodiments may be combined provided that no contradiction or exclusion is caused. For example, in the first modified example, the recording mode may be switched similarly to each of the second to fifth modified examples. In the first to fifth modified examples, the recording mode may be switched similarly to the sixth modified example. In the first to sixth modified examples and the second embodiment, the resolution of the image I by the second recording mode may be higher than that by the first recording mode as in the seventh modified example.

From the above description, many modifications and other embodiments of the present disclosure are apparent to those skilled in the art. The above description should thus be interpreted as just examples, and is provided to teach those skilled in the art the best mode for carrying out the present disclosure. Details about the configurations and/or the functions described above may be substantially changed without departing from the gist and scope of the present disclosure.

The present disclosure is applicable to an image recording apparatus that is capable of inhibiting a decrease in quality of an image while inhibiting an increase in size of the apparatus, a control method thereof, and a program thereof.

What is claimed is:

1. An image recording apparatus, comprising:

an image recording head configured to record an image on a recording medium;

a carriage configured to move the image recording head in a scanning direction within a scanning range;

a conveyer configured to convey the recording medium in a conveyance direction intersecting with the scanning direction; and a controller, wherein the controller is configured to execute a first recording mode and a second recording mode, in the first recording mode, the controller causes the image recording head to accelerate to a first velocity, to move at the first velocity, and then to decelerate from the first velocity, while causing the image recording head to record the image at least during moving at the first velocity, and in the second recording mode, the controller causes the image recording head to accelerate to a second velocity lower than the first velocity, to move at the second velocity, and then to decelerate from the second velocity, while causing the image recording head to record the image at least during moving at the second velocity, wherein in a case that the controller has determined, based on printing data, that the image is to be recorded in a first velocity changing period including a first acceleration period and a first deceleration period, the controller executes the second recording mode, the image recording head accelerating in the first acceleration period and decelerating in the first deceleration period, and wherein the recording medium is a medium of one body, in a case that the image to be recorded on the medium of one body is to be recorded by a plurality of passes in the conveyance direction, the controller determines, for at least one or each of the passes, whether the image is to be recorded during the first velocity changing period, and in a case that the controller has determined that the image is to be recorded during the first velocity changing period in at least one of the plurality of passes, the controller executes the second recording mode in each of the plurality of passes for the medium of one body without determining whether the image is to be recorded during the first velocity changing period until completion of recording of the image on the medium of one body.

2. The image recording apparatus according to claim 1, wherein, the controller determines that the image is to be recorded during the first velocity changing period, in a case that one or more of an acceleration start position and a deceleration end position is outside the scanning range, the image recording head starting acceleration at the acceleration start position to reach the first velocity at a recording start position, the image recording head starting a deceleration from the first velocity at a recording end position and stopping at the deceleration end position.

3. The image recording apparatus according to claim 1, wherein, the controller determines that the image is to be recorded during the first velocity changing period, in a case that a range obtained by adding an acceleration range and a deceleration range to a recording range between a recording start position and a recording end position is larger than the scanning range, the image recording head moving in the acceleration range during the first acceleration period and moving in the deceleration range during the first deceleration period.

4. The image recording apparatus according to claim 1, wherein the image includes a plurality of images arranged at intervals, and the controller determines whether the image is to be recorded during the first velocity changing period for at least one or each of the plurality of images.

5. The image recording apparatus according to claim 1, wherein the controller executes the second recording mode in a case that the controller has determined that the image is to be recorded in one or more of a part of the first acceleration period and a part of the first deceleration period, a velocity of the image recording head accelerating to reach an allowable velocity lower than the first velocity in the part of the first acceleration period and decelerating from the allowable velocity in the part of the first deceleration period.

6. The image recording apparatus according to claim 5, wherein the allowable velocity is 95% of the first velocity.

7. The image recording apparatus according to claim 1, wherein the controller determines that the image is to be recorded during the first velocity changing period, in a case that borderless printing forming no margin around the image is set, and the recording medium is larger than a predefined size.

8. The image recording apparatus according to claim 1, wherein the controller is configured to make resolution of the image recorded in the second recording mode higher than resolution of the image recorded in the first recording mode.

9. A control method of an image recording apparatus, the apparatus comprising: an image recording head configured to record an image on a recording medium; a carriage configured to move the image recording head in a scanning direction within a scanning range; a conveyer configured to convey the recording medium in a conveyance direction intersecting with the scanning direction; and a controller, wherein the controller is configured to execute a first recording mode and a second recording mode, in the first recording mode, the controller causes the image recording head to accelerate to a first velocity, to move at the first velocity, and then to decelerate from the first velocity, while causing the image recording head to record the image at least during moving at the first velocity, and in the second recording mode, the controller causes the image recording head to accelerate to a second velocity lower than the first velocity, to move at the second velocity, and then to decelerate from the second velocity, while causing the image recording head to record the image at least during moving at the second velocity, the method comprising, executing the second recording mode, in a case that the controller has determined, based on printing data, that the image is to be recorded in a first velocity changing period including a first acceleration period and a first deceleration period, the image recording head accelerating in the first acceleration period and decelerating in the first deceleration period, wherein the recording medium is a medium of one body, the method further comprising:

in a case that the image to be recorded on the medium of one body is to be recorded by a plurality of passes in the conveyance direction, determining, for at least one or each of the passes, whether the image is to be recorded during the first velocity changing period, and in a case that the controller has determined that the image is to be recorded during the first velocity changing period in at least one of the plurality of passes, executing the second recording mode in each of the plurality of passes for the medium of one body without determining whether the image is to be recorded during the first velocity changing period until completion of recording of the image on the medium of one body.

10. A non-transitory computer-readable medium storing a program that is executable by a controller of an image forming apparatus which comprises: an image recording head configured to record an image on a recording medium; a carriage configured to move the image recording head in a scanning direction within a scanning range; a conveyer configured to convey the recording medium in a conveyance direction intersecting with the scanning direction; and the controller, the program, when executed by the controller of the image recording apparatus, causes the controller to be capable of executing a first recording mode and a second recording mode, in the first recording mode, the controller causes the image recording head to accelerate to a first velocity, to move at the first velocity, and then to decelerate from the first velocity, while causing the image recording head to record the image at least during moving at the first velocity, in the second recording mode, the controller causes the image recording head to accelerate to a second velocity lower than the first velocity, to move at the second velocity, and then to decelerate from the second velocity, while causing the image recording head to record the image at least during moving at the second velocity, and the program, when executed by the controller of the image recording apparatus, cause the controller to execute the second recording mode in a case that the controller has determined, based on printing data, that the image is to be recorded in a first velocity changing period including a first acceleration period and a first deceleration period, the image recording head accelerating in the first acceleration period and decelerating in the first deceleration period, wherein the recording medium is a medium of one body, in a case that the image to be recorded on the medium of one body is to be recorded by a plurality of passes in the conveyance direction, the program causes the controller to determine, for at least one or each of the passes, whether the image is to be recorded during the first velocity changing period, and in a case that the controller has determined that the image is to be recorded during the first velocity changing period in at least one of the plurality of passes, the program causes the controller to execute the second recording mode in each of the plurality of passes for the medium of one body without causing the controller to determine whether the image is to be recorded during the first velocity changing period until completion of recording of the image on the medium of one body.

11. An image recording apparatus, comprising:

an image recording head configured to record an image on a recording medium;

a carriage configured to move the image recording head in a scanning direction within a scanning range;

a conveyer configured to convey the recording medium in a conveyance direction intersecting with the scanning direction; and a controller, wherein the controller is configured to execute a first recording mode and a second recording mode, in the first recording mode, the controller causes the image recording head to accelerate to a first velocity, to move at the first velocity, and then to decelerate from the first velocity, while causing the image recording head to record the image at least during moving at the first velocity, and in the second recording mode, the controller causes the image recording head to accelerate to a second velocity lower than the first velocity, to move at the second velocity, and then to decelerate from the second velocity, while causing the image recording head to record the image at least during moving at the second velocity;

wherein in a case that the controller has determined, based on printing data, that the image is to be recorded in a first velocity changing period including a first acceleration period and a first deceleration period, the controller executes the second recording mode, the image recording head accelerating in the first acceleration period and decelerating in the first deceleration period; and wherein in a case that an aggregate image including the image is to be recorded by a plurality of passes in the conveyance direction, the controller determines, for at least one or each of the passes, whether the image is to be recorded during the first velocity changing period, and in a case that the controller has determined that the image is to be recorded during the first velocity changing period in at least one of the plurality of passes, the controller executes the second recording mode for each of the plurality of passes for the aggregate image without determining whether the image is to be recorded during the first velocity changing period until completion of recording of the aggregate image.

12. The image recording apparatus according to claim 11, wherein, the controller determines that the image is to be recorded during the first velocity changing period, in a case that one or more of an acceleration start position and a deceleration end position is outside the scanning range, the image recording head starting acceleration at the acceleration start position to reach the first velocity at a recording start position, the image recording head starting a deceleration from the first velocity at a recording end position and stopping at the deceleration end position.

13. The image recording apparatus according to claim 11, wherein, the controller determines that the image is to be recorded during the first velocity changing period, in a case that a range obtained by adding an acceleration range and a deceleration range to a recording range between a recording start position and a recording end position is larger than the scanning range, the image recording head moving in the acceleration range during the first acceleration period and moving in the deceleration range during the first deceleration period.

14. The image recording apparatus according to claim 11, wherein the image includes a plurality of images arranged at intervals, and the controller determines whether the image is to be recorded during the first velocity changing period for at least one or each of the plurality of images.

15. The image recording apparatus according to claim 11, wherein the controller executes the second recording mode in a case that the controller has determined that the image is to be recorded in one or more of a part of the first acceleration period and a part of the first deceleration period, a velocity of the image recording head accelerating to reach an allowable velocity lower than the first velocity in the part of the first acceleration period and decelerating from the allowable velocity in the part of the first deceleration period.

16. The image recording apparatus according to claim 15, wherein the allowable velocity is 95% of the first velocity.

17. The image recording apparatus according to claim 11, wherein the controller determines that the image is to be recorded during the first velocity changing period, in a case that borderless printing forming no margin around the image is set, and the recording medium is larger than a predefined size.

18. The image recording apparatus according to claim 11, wherein the controller is configured to make resolution of the image recorded in the second recording mode higher than resolution of the image recorded in the first recording mode.

* * * * *